US009243617B2

(12) United States Patent
Bahnev

(10) Patent No.: US 9,243,617 B2
(45) Date of Patent: Jan. 26, 2016

(54) CAM ENGINE

(76) Inventor: Boyan Bahnev, Plovdiv (BG)

( * ) Notice: Subject to any disclaimer, the term of this patent is extended or adjusted under 35 U.S.C. 154(b) by 21 days.

(21) Appl. No.: 14/129,867

(22) PCT Filed: Jul. 30, 2012

(86) PCT No.: PCT/BG2012/000018
§ 371 (c)(1),
(2), (4) Date: Feb. 18, 2014

(87) PCT Pub. No.: WO2013/016780
PCT Pub. Date: Feb. 7, 2013

(65) Prior Publication Data

US 2014/0150643 A1 Jun. 5, 2014

(30) Foreign Application Priority Data

Aug. 2, 2011 (BG) ..... 111007

(51) Int. Cl.

| | |
|---|---|
| ***F01B 13/04*** | (2006.01) |
| ***F04B 9/04*** | (2006.01) |
| ***F01B 3/04*** | (2006.01) |
| ***F01B 9/06*** | (2006.01) |
| *F02B 75/02* | (2006.01) |
| *F02B 57/00* | (2006.01) |
| *F02B 75/26* | (2006.01) |
| *F02B 57/08* | (2006.01) |

(52) U.S. Cl.
CPC ..... *F04B 9/042* (2013.01); *F01B 3/045* (2013.01); *F01B 9/06* (2013.01); *F02B 75/26* (2013.01); *F01B 13/045* (2013.01); *F02B 57/00* (2013.01); *F02B 57/08* (2013.01); *F02B 75/265* (2013.01); *F02B 2075/025* (2013.01)

(58) Field of Classification Search
CPC ..... F02B 75/265; F02B 57/00; F02B 57/08; F02B 2075/025; F01B 13/045
USPC ..... 123/43 R
See application file for complete search history.

(56) References Cited

U.S. PATENT DOCUMENTS

| | | | | | |
|---|---|---|---|---|---|
| 2,243,821 | A | * | 5/1941 | Herrmann | 74/56 |
| 2,664,866 | A | * | 1/1954 | Fulke | 123/51 A |
| 3,016,110 | A | * | 1/1962 | Herrmann | 184/6.17 |
| 3,841,165 | A | * | 10/1974 | Layfield et al. | 74/56 |
| 3,943,895 | A | * | 3/1976 | Howell | 123/56.7 |
| 3,967,535 | A | * | 7/1976 | Rozansky | 91/197 |
| 4,274,327 | A | * | 6/1981 | Olsgaard | 91/196 |
| 4,287,858 | A | * | 9/1981 | Anzalone | 123/43 AA |
| 2003/0074897 | A1 | * | 4/2003 | Rollston | 60/517 |

FOREIGN PATENT DOCUMENTS

| | | | |
|---|---|---|---|
| EP | 1937938 | A1 * | 7/2008 |
| WO | WO 2007036007 | A1 * | 4/2007 |

* cited by examiner

*Primary Examiner* — Lindsay Low
*Assistant Examiner* — Charles Brauch

(57) ABSTRACT

The invention relates to a cam engine used in different field of the mechanical engineering, as internal-combustion engines, compressors, pumps etc. The cam engine comprises cylinders (26) with pistons (25), cylindrical tubular 3D cam (20) having a cam groove on the inner cylindrical surface and at least two asynchronously moving followers (1*a* and 1*b*) with arms (37) having main and additional rollers (3, 5).

19 Claims, 15 Drawing Sheets

$\omega=\omega_1+\omega_{2\ RELATIVE}+\omega_{3\ RELATIVE}$

CAM ENGINE

FIELD OF THE INVENTION

The invention relates to a piston cam engine and particularly to an opposed-piston cam engine that may find application in different fields of mechanical engineering, e.g. internal combustion engines, compressors and etc. Engines, constructed according to this invention, could be used in various land, water and air vehicles, as well as in stationary aggregates.

BACKGROUND OF THE INVENTION

One of the common problems of the cam mechanisms is the relatively more rapid wear in comparison to the mechanisms which links are connected by hinged joints.

The main reasons for the intensive wear of cam mechanisms are friction between the cam surface and the element, which is in contact with it; greater contact force transmitted by a very small area between the cam profile and the element in contact with the cam; as well as a break of contact between the cam and the element contacting with its profile and subsequent impact recovery of the contact between them.

Wearing of the cam mechanisms can be reduced to different extent, depending on the requirements to the cam engine and the intended function of the cam mechanism in the given engine.

It is known from EP19379388 a cam engine comprising a housing, at least one cylinder, at least one piston moving in the cylinder, a cylindrical tubular 3D cam with a cam groove on the inner cylindrical surface, which groove is made so that the line forming its cross-section is a straight or concave line whose lower end is located at the side towards the axis of the 3D cam, and at least two equal-mass follower positioned against each other, at least one of which is a working follower, where each follower comprises at least two arms standing at an angle to each other and having main rollers bearing at the free ends of the corresponding arm, and each follower also comprises additional rollers that can move along the axes of the corresponding main rollers, so that each main and additional roller contacts the cam groove. The problem of the intensive wear of the cam mechanism of this known engine is comparatively well settled. In this case each follower is provided not only with main rollers, but also with additional ones, which contact with the profile of the cam groove opposing the cam profile with which the additional rollers of the same follower are in contact. The additional rollers are elastically connected to their respective follower and press it to the cam profile of its adjacent main rollers. This design solution is able to provide constant contact between the followers and their respective cam profiles, if the elastic elements of the additional rollers are hard enough to counteract the effect of the inertia forces of the followers when inertia forces act to interrupt the connection of the followers and the cam. On the other hand, the additional rollers have considerably smaller diameters than the diameters of the main rollers and the cam groove is characterized with constant cross-section, due to which each additional roller will be constantly moving along the axis of its respective main roller when each of them follows the adjacent cam profile. Therefore, each elastic element that presses its corresponding additional roller will constantly shrink and stretch. The shrinking and stretching of the elastic elements will cause unsteady operation of the cam mechanism, which causes altering moments of acceleration and slowdown of the rotation of the main transforming 3D cam. The movement of the known cam mechanism is insofar uneven as the difference between the diameters of the main and additional rollers.

Additionally, in this known piston cam engine there is some loss resulting from the constant shrinking and stretching of the elastic elements, as well as loss resulting from the friction between the additional rollers and the cam profiles. The loss resulted from the friction of the additional rollers in the known engine is due to the fact that they cannot self-adjust while rolling along the corresponding cam profiles, since they only move reciprocally along the axis of the main rollers. As a result friction forces are generated, which cause mechanical loss and wear of the cam mechanism.

Moreover, in this known cam engine, the movement of the additional rollers along the axis of the main rollers is not limited, and thus the use of elastic elements with high hardness and preload is necessary to be applied in order to prevent interruption of contact between the cam and followers when there are inertia forces acting towards their disconnection. When the inertia forces are not aiming to break the contact between the cam and the followers, the additional rollers will be pressed by the elastic elements to their adjacent cam profile with unnecessarily large forces, leading to a faster wear of the cam profile.

This known patent EP19379938 also discloses laws of motion of the piston cam engine, due to which its operation is improved. These laws, however, do not completely guarantee the contact between the followers and the main transforming cam.

SUMMARY OF THE INVENTION

The problem solved by the present invention is to provide technical solutions that improve the functional reliability of the apparatuses having a cam mechanism and in particular piston cam engines.

These and other problems are solved by a cam engine comprising a housing, at least one cylinder, at least one piston moving in the cylinder, cylindrical tubular 3D cam with a cam groove on the inner cylindrical surface, which groove is made so that the line forming its surface cross-section is a straight or concave line whose lower end is located at the axis of the 3D cam, and at least two asynchronously moving equal-mass followers, positioned against each other, at least one of which pistons is a working piston. Each follower comprises at least two arms, standing at an angle to each other and having main rollers bearing at the free ends of the corresponding arm, and each follower also comprises additional rollers that can move along the axes of the corresponding main rollers, so that each main and additional roller contacts the cam groove. Besides the additional rollers have the possibility to rotate in relation to the axes of their corresponding main rollers, so that they are able to self-adjust to achieve rolling without sliding. Thus, the additional rollers can move in parallel and rotate around the axes of their corresponding main rollers at the same time, whereat a rolling without sliding takes place. The additional rollers include stoppers for limiting their movement along the axes of the main rollers, which additionally reduces the possibility of breaking the contact between the main rollers and their corresponding cam profiles without the preloading of the elastic elements used being too high. Thus, the movement of the additional rollers is kept within acceptable limits. The cam groove is characterized with periodically changing cross-section, depending on the number of the convex and concave sections of the profile of the 3D cam. This reduces the linear movement of the additional rollers compared to the corresponding main rollers.

In one embodiment of the invention, the cam engine has a cam groove, which is made so that at the top and bottom dead centers the distance between the cam profiles of the groove of the 3D cam in the cross-section is the greatest, and the distance in the cross-section between the cam profiles of the groove of the 3D cam between the two dead centers is the smallest. This reduces to the maximum possible extent the movement of the additional rollers in comparison with the axes of their corresponding main rollers. When the cam groove is shrinking, the distance between the centers of the axes of each pair of main and additional rollers remains constant and therefore the relative movement between any additional roller and the corresponding main bearing journal is eliminated.

In another embodiment of the invention, the cam groove is realized in such a way that along the lines of rolling of the rollers narrower grooves are made so that their greatest depth is at the top and the bottom dead centers, and that between the two dead centers their depth is zero is minimum, so that the movement of the additional rollers along the axes of the main rollers to be maximum reduced. In one alternative embodiment, the cam groove is made in such a way that along the lines of rolling of the rollers there are narrower convex paths made so that the height of these paths is the greatest between the top and the bottom dead centers, and that at the top and bottom dead centers their height is minimum, so that the movement of the additional rollers along the axes of the main rollers to be maximum reduced. These alternative forms allow using a different approach to reduce maximally the moving of the additional rollers along the axes of the main rollers.

In another embodiment of the invention there are at least two main rollers mounted at the free end of each arm of the followers, which are independently bearing to the corresponding arm of the follower. This allows the main rollers which are mounted on a single axis to rotate at different revolutions, regardless of the fact that they interact with the same cam profile.

In another preferred embodiment of the invention, the 3D cam is composite and comprises two coaxial bushings, each having a corrugated cam profile on one side, and the cam bushings are spaced from one another with their corrugated edges positioned so that the convex parts of the cam profile of the one of the bushings stand against the concave parts of the cam profile of the other bushing. Besides it also comprises at least two leading columns for reciprocating linear motion of each piston, which columns are parallel and equidistant to the axis of the 3D cam.

In another preferred embodiment of the invention the corrugated cam profile is made so that its curve of the law of motion of the followers in function of the angle of rotation of the 3D cam is formed by consecutively alternating ascending and descending sections, whose connection results in equal number of convexities and concavities, the total number of which is equal to or multiple by the sum of the number of arms of the followers. Thus, the curve is continuous at least up to its second derivative in one complete rotation of the cam at 360°, including for both end points. Such cam profile guarantees that the velocities and accelerations of the followers at the end of each ascending and descending section are equal to their velocities and accelerations at the beginning of the next section, due to which a smooth transition of the followers when changing their direction of movement is achieved. Moreover, the curve is symmetrical for each two adjacent sections, descending and ascending, i.e. the straight line, that passes through the connection point of two adjacent sections, is perpendicular to the tangent to the curve at this point represents the axis of symmetry for these sections. Such cam profile provides that the opposed main rollers of one follower are in simultaneous contact with their corresponding cam profile.

In still another preferred embodiment of the invention, each ascending and descending section of the curve has one maximum and one minimum value of its second derivative, which do not coincide with the end points of the respective section. Thus, low velocities of the pistons are achieved around their dead center positions. In a more preferred embodiment, the values of the second derivative of the curve are equal to zero at the connection points of each two adjacent sections. In this way, the velocity of the pistons around their dead centers is reduced even further. Most preferably, identical straight sections are included in the area of the points of junction of the curve. By such a curve of the cam law, a maximum possible slowdown of the pistons around their dead centers is achieved.

In another embodiment of the invention, the cam engine also comprises an electrical rotor, rigidly connected to the 3D cam and a stator, rigidly connected to the housing of the engine, in order to realize a combination between a piston engine and an electrical engine. The electric engine functions as an electric motor or a generator, depending on the type of output energy—electrical energy or energy derived from the work of the piston engine. Such a combined engine is compact and has a low manufacturing cost, since it does not need independent housing and storage for the electrical engine.

In one another embodiment of the invention the cam engine comprises also an input and/or output shaft, an electric rotor, rigidly connected to the incoming and/or outgoing shaft and a stator, rigidly connected to the housing in order to realize a combination between a piston engine and an electrical engine. This embodiment allows generating from or imputing to the piston cam engine not only electrical, but also mechanical energy.

In one subsequent embodiment of the invention, the cam engine also comprises means to deliver and discharge of working fluid.

In still another embodiment of the invention at least the main and additional rollers are external bearing rings of composite bearings, including multiple bearing rings with different diameters, arranged concentrically to each other and the connection between them is either sliding or via rolling bodies. Thus the friction forces in the composite bearings are reduced.

The invention also relates to a compressor or a pump that comprises at least one cam engine described above.

The present invention also relates to a motor that includes at least one cam engine presented in the above described embodiments. In one embodiment, the motor also includes at least one kinematic chain having a 2D cam connected to the 3D cam; at least one intake or exhaust valve located in a cylinder head; a rocker that is connected by means of cylindrical joint to a stationary component of the engine, and the rocker has one arm by which it makes a contact with the 2D cam, and at least one other arm, each contacting with an intake or exhaust valve.

In another embodiment the motor also comprises a supercharging mechanism having at least one valve for opening the housing to let the atmospheric air in when the pistons are moving apart, located on the housing, and at least one 2D cam for managing the movement of the valve, which 2D cam is mounted to the 3D cam.

In still another embodiment the motor includes a supercharging mechanism, comprising at least one diaphragm pump, positioned on the housing of the motor for compressing the atmospheric air in the intake manifold of the motor, and at least one 2D cam to activate the motion of the diaphragm pump, which 2D cam is fixed to the 3D cam.

In another embodiment of the motor, it comprises one operating cylinder, functioning as a heat engine, and one opposed cylinder, functioning as a compressor or a pump. In one preferred embodiment of the motor, the opposed cylinder is a cylinder of a compressor and also having a pneumatic accumulator for feeding the operating cylinder with at least a part of the compressed air from the opposed cylinder and for keeping the air and/or for preparing the fuel-air mixture for the next working cycle of the operating cylinder.

Thus, the motors disclosed above function more effectively and reliably, while realizing a split working cycle, compared to engines that realize split cycle with a traditional crank mechanism. While realizing a split cycle of the functioning of the engine, one of its cylinders is used only for the suction and compression of the working fluid, and the combustion process, expansion and release of exhaust gases are taking place in the other cylinder.

The field of utilization of the cam engine of the invention expands in case the latter is realized as any kind of combination of internal combustion engine, pump, compressor, electric motor and generator. These combinations are preferable, when different types of energy are in demand. In this case, the 3D cam represents a means for receiving or transmitting mechanic and/or electrical energy.

In the cases, when using engines with a small working volume is necessary, it is beneficial the cam engine to have one operating cylinder. In this case, one of the two operating cylinders and his relevant piston, head and means for delivery and discharge of the working fluid are removed. In place of the piston, a balancing component is mounted in such a way that the weight of the follower with the piston equals the weight of the follower with the balancing component.

In other cases, when using engines with a large working volume is necessary, the integration of several piston cam engines, connected by means of their tooth gears transmitting the rotary motion of their composite cams to at least one outgoing shaft of the engine, is appropriate.

DETAILED DESCRIPTION OF THE INVENTION

According to the invention, different two- or one-piston cam engines can be realized, which execute different working cycles depending on the specific application of the engine that can function as a compressor, pump, internal combustion engine or a combination of the above-mentioned.

Figure 1A:
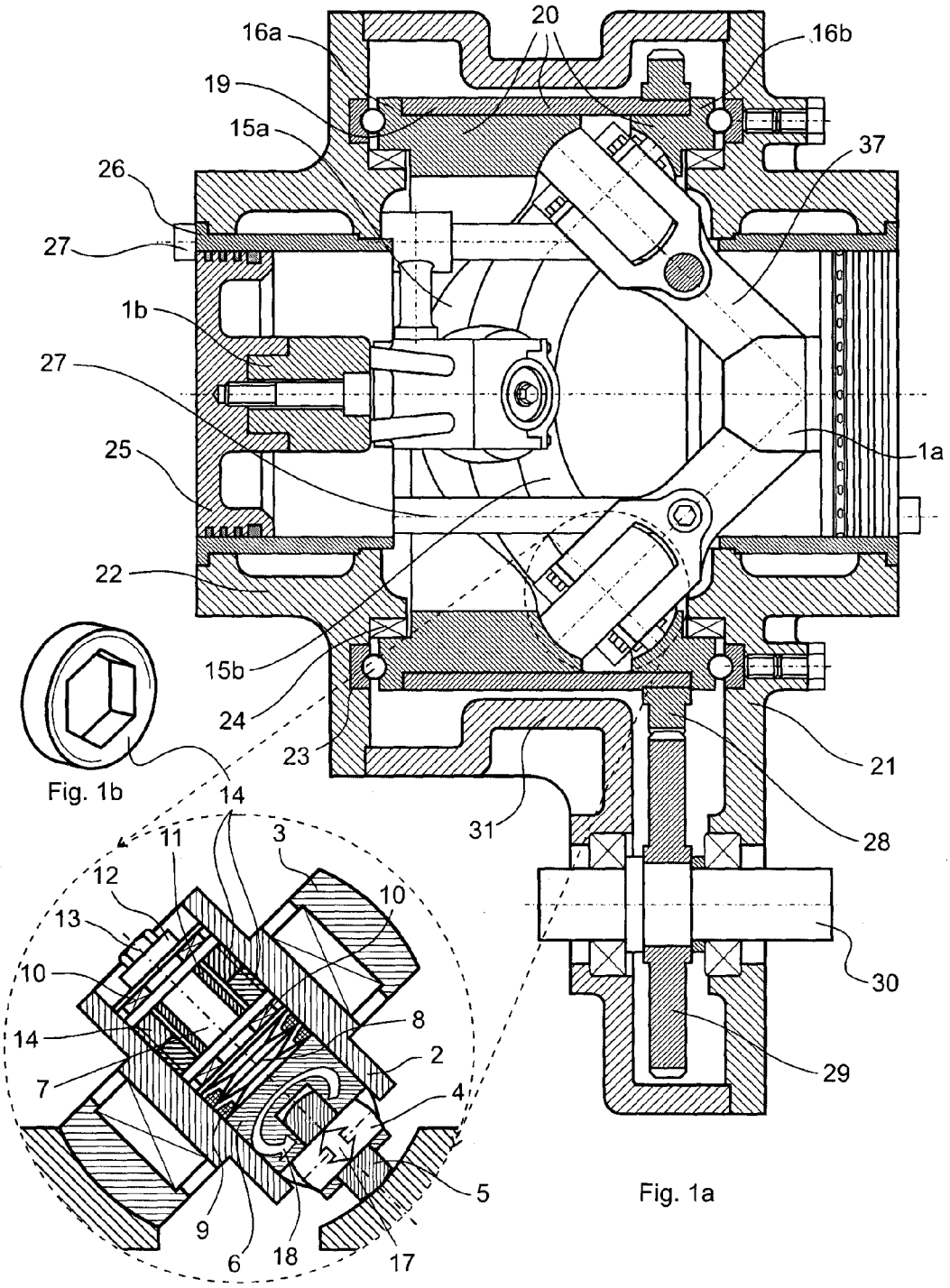
FIG. 1*a* shows two-piston cam engine with additional rotational degree of freedom for its additional rollers.
Figure 1B:
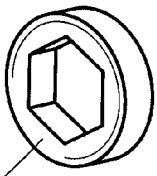
FIG. 1*b* shows positioning nut—limiting component for the elastic elements.

FIG. 1*a* and FIG. 1*b* show one embodiment of two-piston cam engine according to the invention. The engine comprises a tubular 3D cam 20, which is an assembly of cam bushings 16*a* and 16*b* and a tubular element 19 that orientates cam bushings 16*a* and 16*b* in such a way that their cam profiles 15*a* and 15*b* form a cam groove on the internal surface of the 3D cam 20. The engine comprises two identical followers 1*a* and 1*b* as well, each one of them having two arms 37. To the free ends of the arms 37, which in this case are shaped as bearing forks, main bearing journals 2 and main rollers 3 are mounted. The main bearing journals 2 are of tubular geometry and in their cylindrical cavities additional bearing journals 4 and additional rollers 5 are located. The additional bearing journals 4 are mounted on cylindrical plungers 6, which have cylindrical tails 7. A group of belleville springs 8, limiting rings 9, two axial bearings 10, spacers, respectively 11 and 12, are mounted on each plunger tail 7, and by a screw 13 these elements 8 to 12 are pressed on both sides of two positioning nuts 14, shown on FIG. 1*b*. The positioning nuts 14 mutually secure themselves against self-unscrewing. On their two sides the axial bearings 10 are mounted that allow the free rotation of the additional bearing roller 5 and the self-aligning of the same in relation to its respective cam profile 15*b* possible. Thus the additional bearing roller 5 has two relative degrees of freedom in relation to bearing journal 2, namely one translational along the axes 17 and one rotational 18. Through the translational degree of freedom 17, the additional roller 5 is in continuous contact with the respective cam profile 15*b*, and through the rotational degree of freedom 18 the additional roller 5 is self-oriented towards the profile 15*b* in such a way, that the relative motion of the additional roller 5 towards the adjacent cam profiles 15*b* is the only rolling without sliding. The main rollers 3 of the followers 1*a* and 1*b* contact the cam profiles 15*a* and 15*b* of the cam bushings 16*a* and 16*b* respectively. The 3D cam 20 is mounted in cylinder blocks 21 and 22 through one axial and one radial bearings 23 and 24 at each side. Each follower is connected to one piston 25, which is situated in the respective cylinder 26. The axes of cylinders 26 coincide with the axis of the composed cam 20. The axial guidance of the followers is accomplished by guiding columns 27, mounted on bearings in cylinder blocks 21 and 22. The reciprocal motion of followers 1*a* and 1*b* is transformed into rotation of the 3D cam 20, which transfers the rotational motion to a gear 28, which is rigidly connected to the 3D cam 20. The gear 28 is coupled with a gear 29, which sets into motion an output shaft 30. The shaft 30 is positioned on bearings in the cylinder block 21 and the housing 31.

Figure 1C:
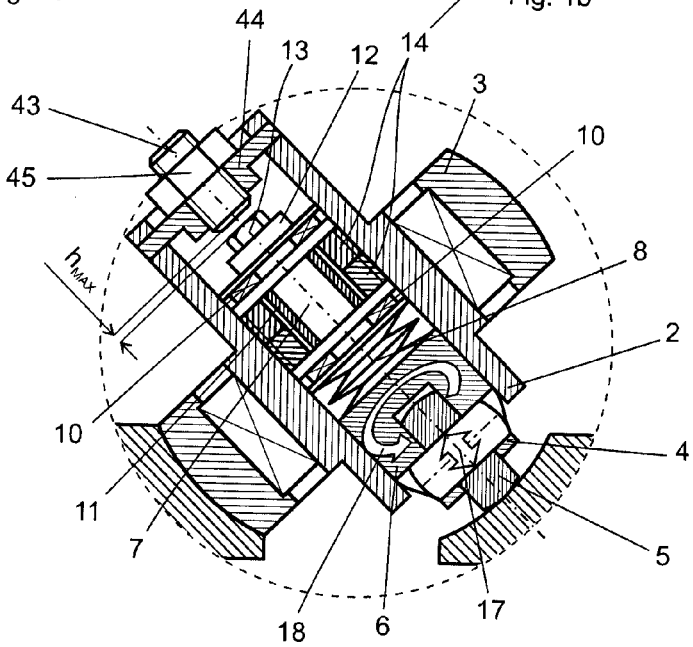
FIG. 1*c* shows bearing assembly of a pair main and additional roller with a stop element that limits the movement of the additional bearing roller in relation to its main bearing journal.

FIG. 1*c* presents a second constructive option of the bearing assembly of a pair main and additional roller. This assembly, unlike the one presented in FIG. 1*a*, is equipped with the additional stop element 43, which functions as the limiting rings 9 in FIG. 1*a*. The stop element 43 does not allow the movement of the pack of elements 8-12 to exceed the limit, preset by its position. In this specific case, the stop element is the adjustable screw 43, screwed in plate 44, which in turn is mounted on the internal end of the main bearing journal 2. Through screw 43, secured against self-unscrewing by counter nut 45, the maximum admissible clearance is preset between the face of screw 43 and the head of screw 13. The clearance is preset, when follower 1*a* or 1*b* is at the top and bottom dead centers, and the size equals the maximum relative movement of the additional rollers in relation to their respective main bearing journals. The design alternative presented in this figure makes it possible to accomplish a more precise adjustment of limiting clearance.

A preferred way to achieve a periodically changing cross-section of the 3D cam groove is to modify the cam profiles law, which can be achieved by summation of the law, in which the cam groove has a constant cross-section, with the half of a law which is the imaginary axial movement of the cam bushing one to another as a function of the angle of rotation of the 3D cam. The modification is made so that the relative movement between any additional roller and its corresponding bearing journal is eliminated. When summing up these laws, the cam groove transforms to a groove with a variable cross-section. An acceptable approximation of the modifying function is any continuous function of the angle of rotation of the 3D cam that reduces the relative movement between each additional roller and its corresponding main bearing journal, and that also does not cause interruption of the resulting law after its summation with the primary law in the case of which the cam groove has a constant cross-section.

Figure 2A:
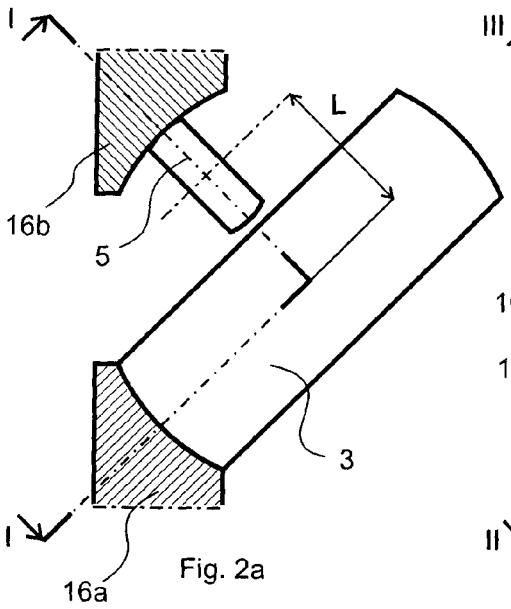
FIG. 2*a*, FIG. 2*b* and FIG. 2*c* show location of one pair main and additional rollers in case of a cam groove with a constant cross-section.
Figure 2B:
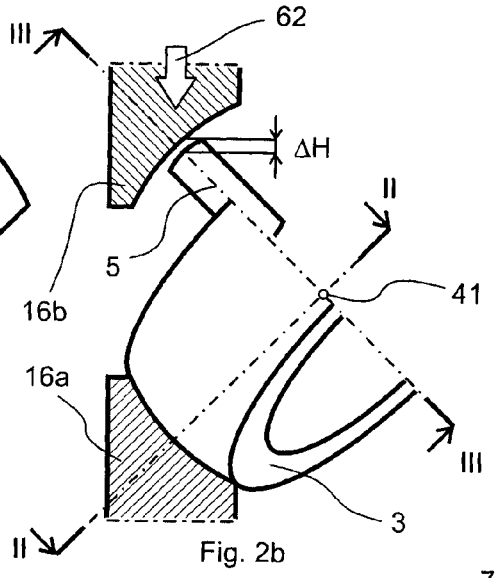
Figure 2C:
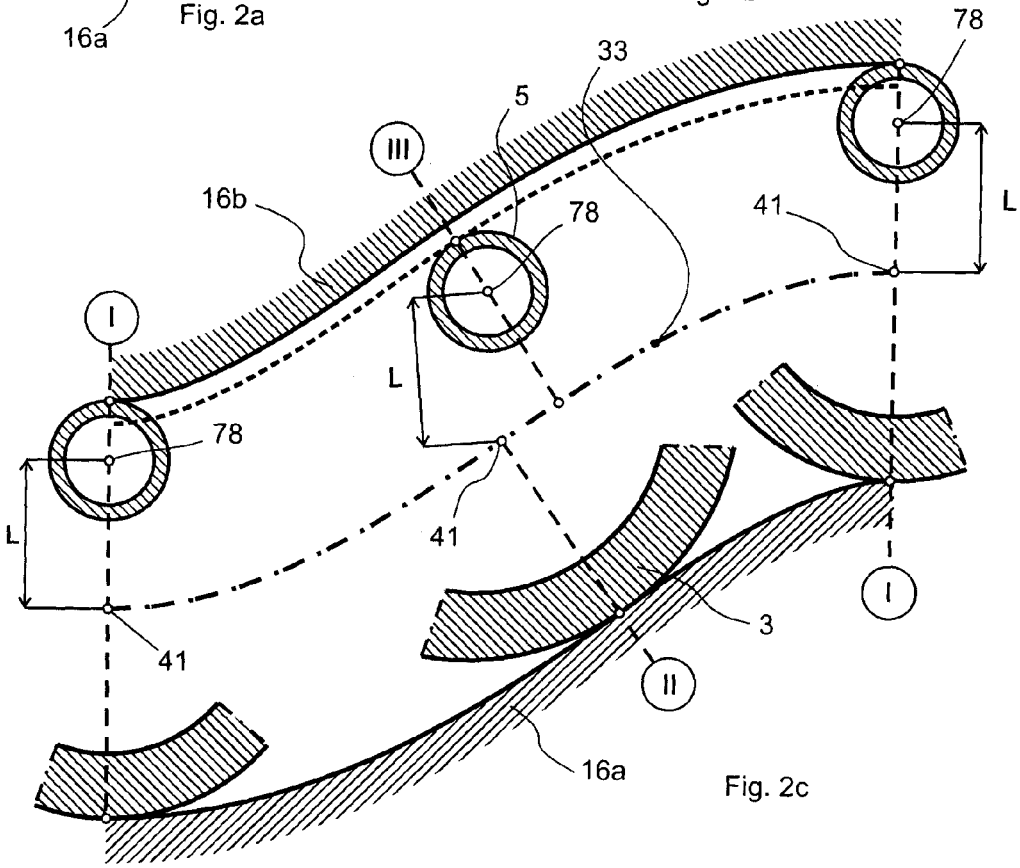

FIG. 2*a*, FIG. 2*b* and FIG. 2*c* clarify the reasons for the appearance of the relative movement of the additional rollers 5 in relation to their respective main bearing journals 2 when the 3D cam 20 is rotating and it has constant cross-section of the cam groove. FIG. 2*a* illustrates the mutual disposition of one pair main and additional rollers, respectively 3 and 5, in cross-sections of the cam groove corresponding to the top and bottom dead centers (TDC/BDC) of pistons 25. FIG. 2*b* shows the cross-sections of the cam groove, corresponding to one intermediate angle of rotation of the 3D cam 20 between the top and bottom dead centers of the pistons 25. FIG. 2*c* shows ¼ of the unfolded cam profiles 15*a* and 15*b*, on which a pair of main and additional roller are located in TDC and BDC (positions I), as well as their positioning when the followers are not located in TDC or BDC. Thus, in TDC and BDC of pistons 25 the contact cross-sections of the rollers 3 and 5 with the respective cam profiles 15*a* and 15*b* are located on the same cross-section of the cam groove and the distance between their midpoints 41 and 78 is minimum and equal to L (FIG. 2*a* and FIG. 2*c*, position I). When the pistons 25 are not in TDC or BDC, the contact cross-sections of rollers 3 and 5 together with the respective cam profiles 15*a* and 15*b* are not located on the same cross-section of the 3D cam 20 (FIG. 2*b* and FIG. 2*c*, positions II and III). It is obvious, that if the distance between midpoints 41 and 78 of the axes of the rollers 3 and 5 remains equal to L, the roller 5 would not be in contact with cam profile 16*b*. Hence, in order to provide simultaneous contact of the rollers 3 and 5 with the adjacent cam profiles 15*a* and 15*b*, and to keep unchangeable the distance between midpoints 41 and 78 of the axes of the rollers 3 and 5 (equal to L), when the pistons 25 are situated between TDC and BDC, the cam bushings 16*a* and 16*b* have to be put close to each other, and when the pistons 25 get near to their dead centers, cam bushings 16*a* and 16*b* have to be pulled back. The maximum displacement of the bushings 62 is marked with ΔH on FIG. 2*b*.

Figure 3A:
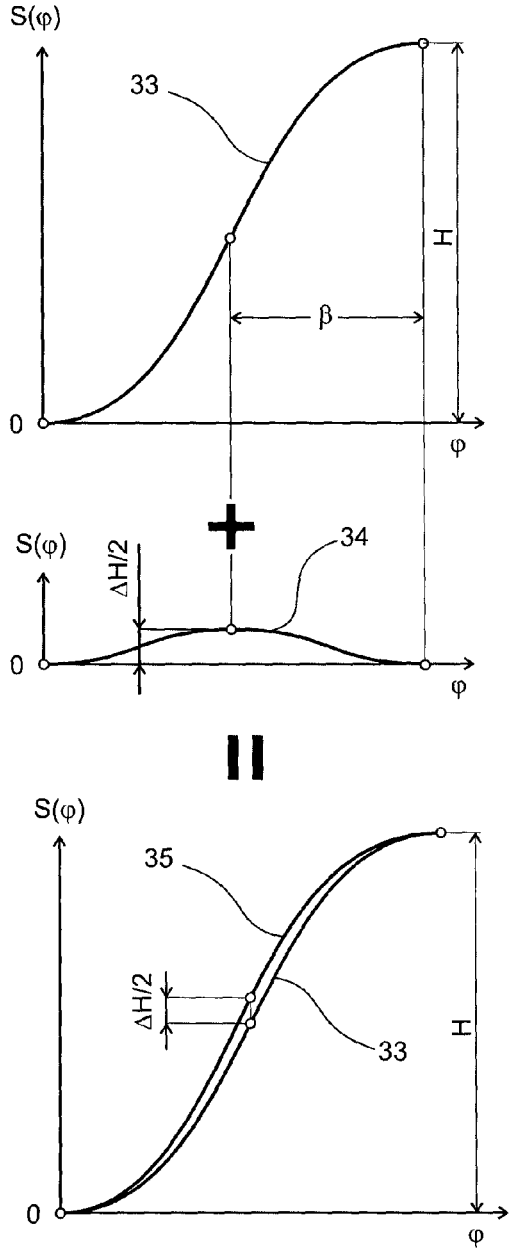
FIG. 3*a* and FIG. 3*b* show example of a modified law and acceleration of a cam with a variable cross-section.
Figure 3B:
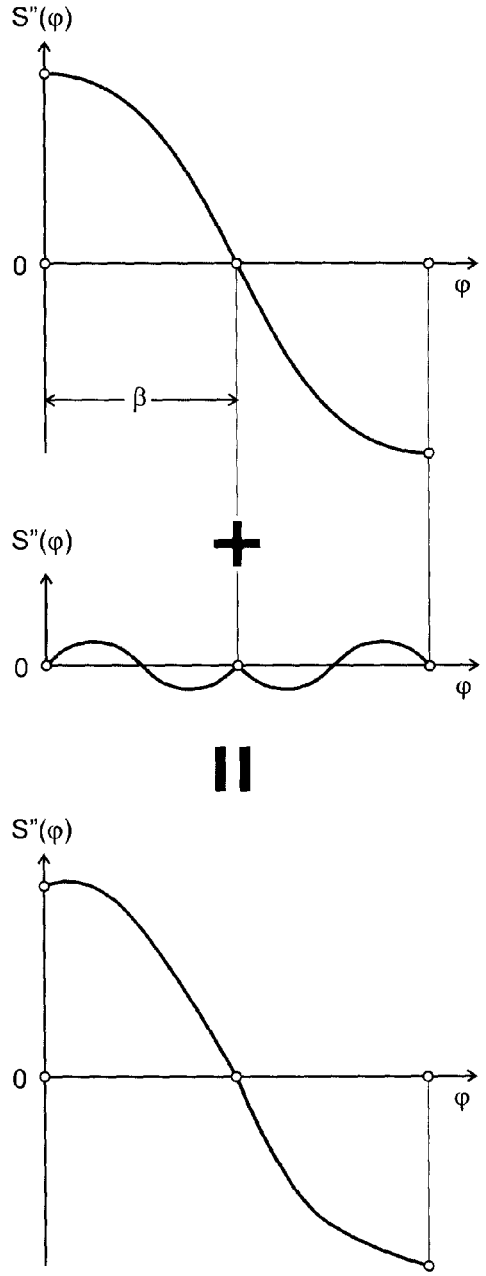

FIG. 3*a* and FIG. 3*b* show a way to remove or significantly decrease the relative moving of additional rollers 5 in relation to their respective main bearing journal 2. This way is associated only with modification of the law of motion of the followers 1*a* and 1*b*, by which the cam profiles 15*a* and 15*b* are manufactured respectively of the cam bushings 16*a* and 16*b*. According to the invention, it is desirable that the modification of the law of the followers 1*a* and 1*b* to be realized by summing the unmodified law 33, where the cam groove is with a constant cross-section, with an approximation of a modifying law 34, the maximum of which is equal to the half of the maximum displacement □H in FIG. 2*b*. Using of the approximation of the modifying law 34 instead of an actual modifying law is acceptable when the approximating law 34 can be presented analytically using one or more formulas and its application instead of the actual modifying law decreases the relative displacement of the roller 5 in relation to its respective main bearing journal 2, compared to the case in which the 3D cam 20 has a constant cross-section. The residual displacement after the application of the approximating law 34 causes shrinking and expansion of the group of the belleville springs 8, but with considerably smaller energy consumption in comparison with the case, when the law of the followers is not modified. The shrink of springs 8 is limited by the thickness of limiting rings 9 or the position of screw 43. It can be seen in the figures, that the resulting law is continuous to its second derivative and its shape and nature are slightly changed after its modification.

Figure 4A:
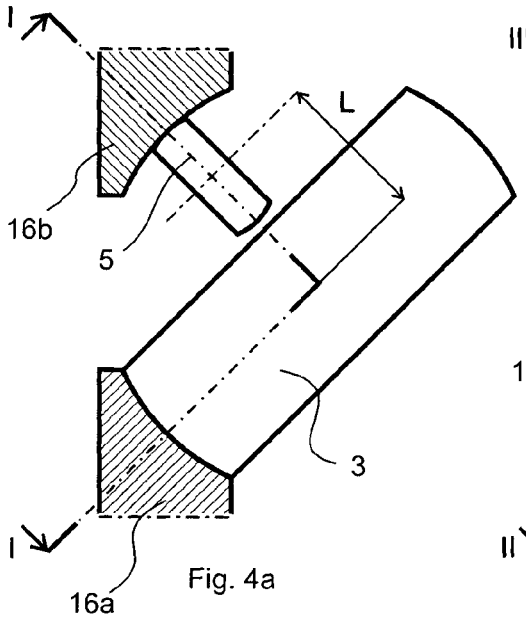
FIG. 4*a*, FIG. 4*b* and FIG. 4*c* show location of one pair main and additional roller in case of a cam groove with a variable cross-section.
Figure 4B:
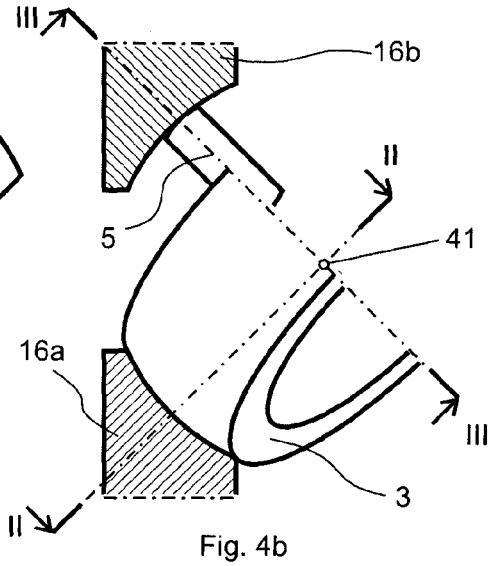
Figure 4C:
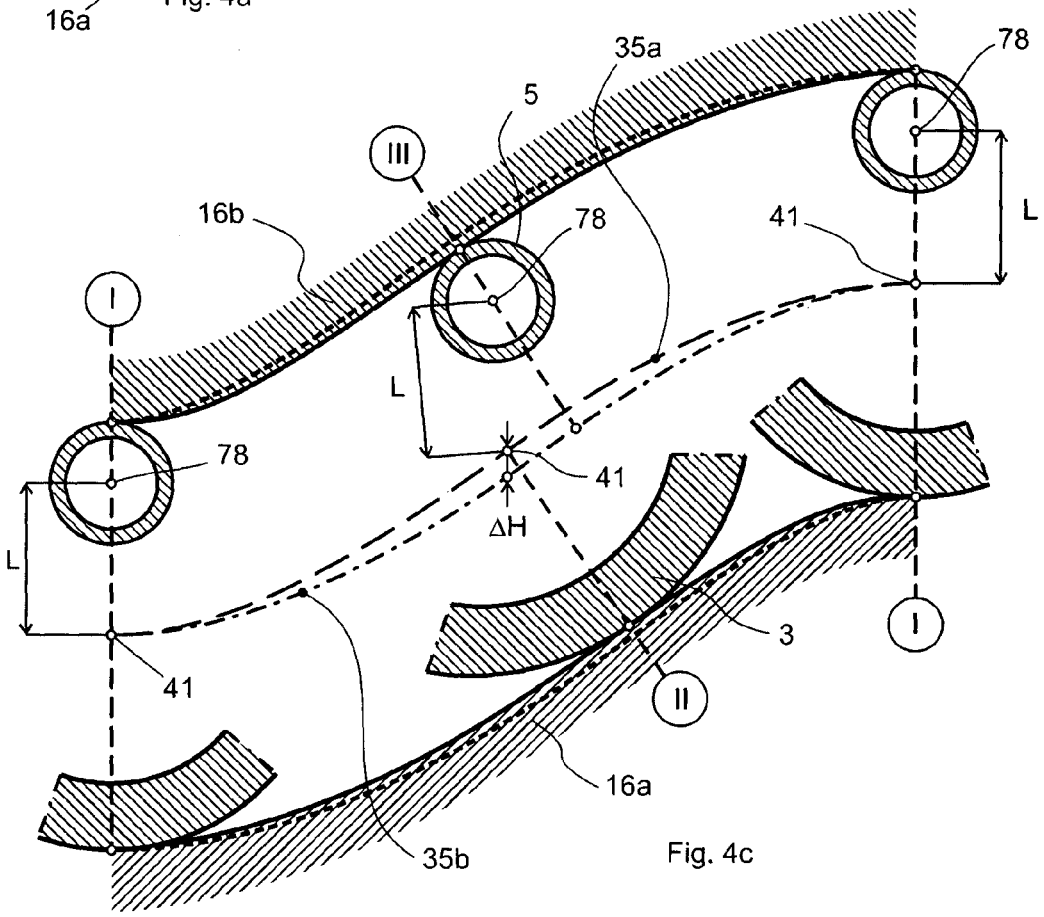

FIG. 4*a*, FIG. 4*b* and FIG. 4*c* are analogous to FIG. 2*a*, FIG. 2*b* and FIG. 2*c* and show the changes that occur in the mutual disposition between each pair of the rollers 3 and 5 after the modification of the law 33 of the cam profiles 15*a* and 15*b*, mentioned above. It is obvious from the figures that the rollers 3 and 5 are in a permanent contact with their respective cam profiles 15*a* and 15*b* without changes in the distance between the midpoints 41 and 78 of their axes. The law of cam profile 15*a* is shown in FIG. 4*c* with a dash line 35*a* and the law of profile 15*b*—with an axial line 35*b*. In the same FIG. 4*c*, the profile of unmodified cam bushings is shown with dotted line, which illustrates the difference between unmodified cam groove with constant cross-section and modified cam groove with altering cross-section. This figure makes it clear that the cross-section of a modified cam groove decreases, excluding the places, which correspond to the dead centers of the followers 1*a* and 1*b*. The maximum decrease characterizes those places of the cam groove that are in the middle of the sections between the dead centers of the followers 1*a* and 1*b*.

Figure 5:
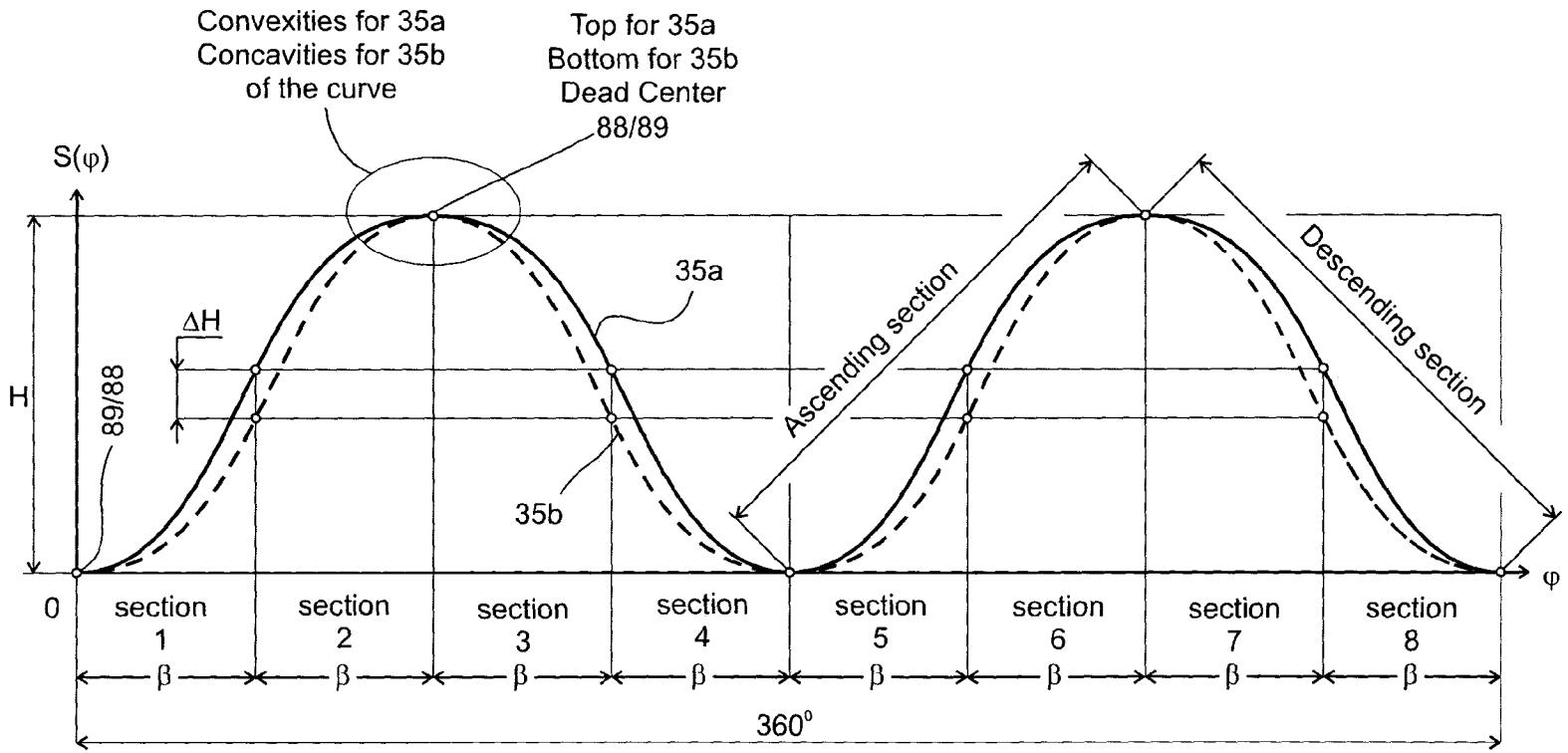
FIG. 5 shows mutual disposition of the laws of the cam profiles of the opposed cam bushings in case of grooves with variable cross-section.

FIG. 5 shows the laws of motion of the followers 1*a* and 1*b* for a complete rotation)(360° of 3D cam 20. The law 35*a* of the follower 1*a* is drown by a continuous line and the law 35*b* of the follower 1*b*—by a dash line. The law 35*a* is identical to law 35*b*, but for the purposes of illustration, the law 35*b* is twice rotated in an inversed manner in relation to the horizontal and the vertical axes and is laid on law 35*a* in such a way, that the dead positions of the followers coincide. When the laws of cam bushings 16*a* and 16*b* are not modified and the cam groove is with a constant cross-section, the law 35*a* coincides with the law 35*b*.

The modified laws 35*a* and 35*b*, presented in FIG. 5 are composed based on a sine function:

$$S(\varphi)_{33} = \frac{H}{2} - \frac{H}{2} \cdot \sin\left(\frac{\pi}{2} + 2\varphi\right),$$

that functions as the law 33, in which the cam groove has a constant cross-section and a cycloid function:

$$S(\varphi)_{34} = \Delta H \cdot \left[\frac{\varphi}{\beta} - \frac{1}{2\pi} \cdot \sin\left(2 \cdot \pi \frac{\varphi}{\beta}\right)\right],$$

used in this case as approximate modifying law 34, where □ is the rotation angle of cam 20; S(□) is motion law of executive units; H is the stroke of the piston; and □ is the rotation angle of the 3D cam 20 when the law 34, shown in FIG. 3*a*, FIG. 3*b* and FIG. 5, reaches its maximum.

In the described example, the pistons 25 execute four strokes per a revolution of the 3D cam 20. The table below presents the specific forms of the functions for each section of the law of the follower 1*a*.

Figure 6A:
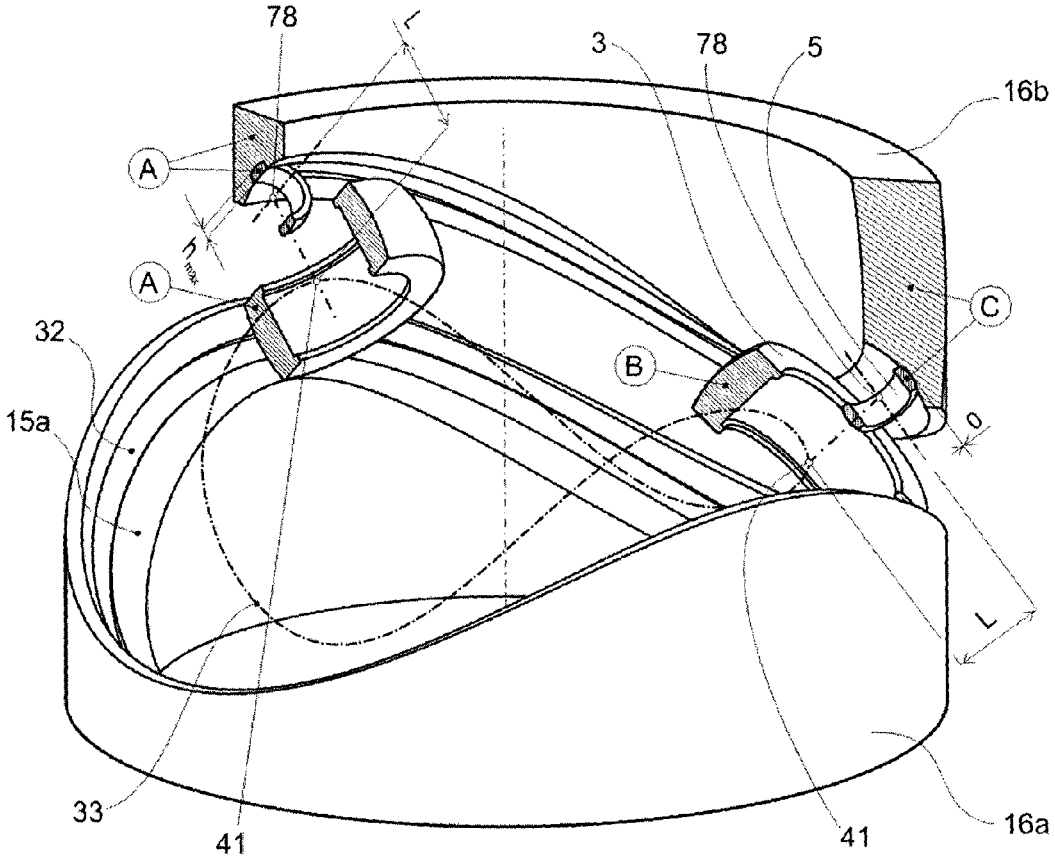
FIG. 6*a*, FIG. 6*b* and FIG. 6*c* show cam bushings with narrower grooves for the additional rollers.
Figure 6B:
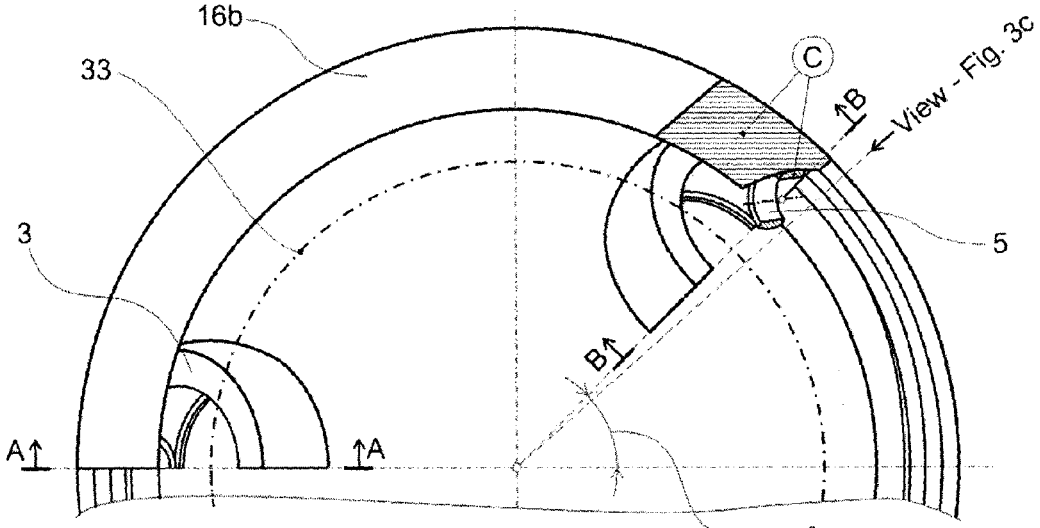
Figure 6C:
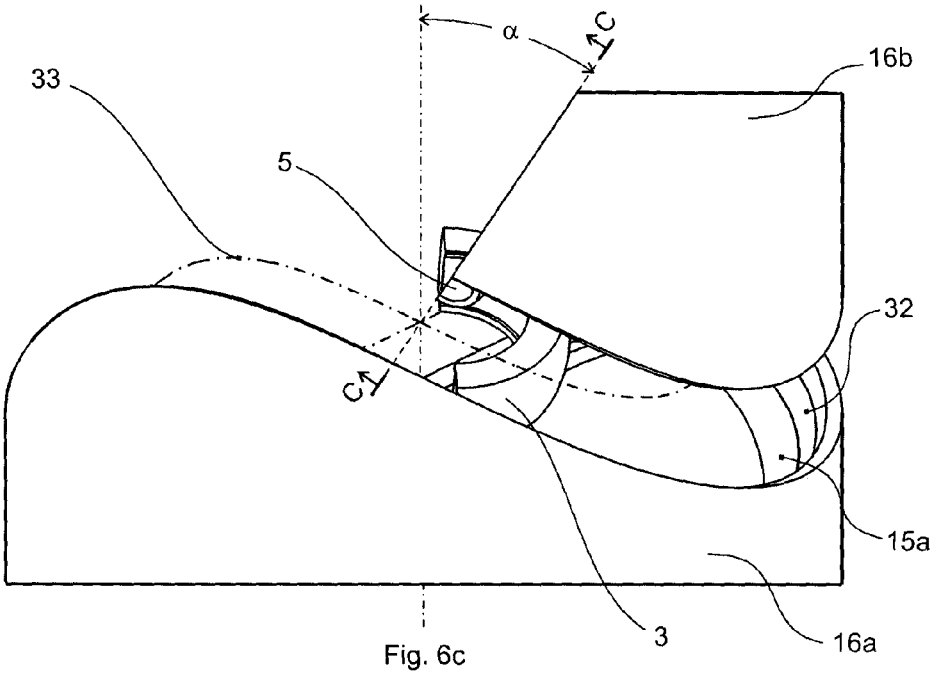

FIG. 6*a*, FIG. 6*b* and FIG. 6*c* show one another way to keep the distance between the midpoints 41 and 78 of the axes of one pair of the main and additional rollers, respectively 3 and 5 practically constant, without moving the cam bushings 16*a* and/or 16*b* and when the 3D cam 20 is rotating. To achieve this objective, additional cam narrower grooves 32 for the additional rollers 5 are carved on cam profiles 15*a* and 15*b*. The depth of the additional grooves h is maximal at the places corresponding to TDC or BDC of pistons 25 and is equal to zero between any neighboring dead centers. In this case the cam bushings 16*a* and 16*b* are situated closer one to another (ΔH) compared to the case in which the cam paths are convex (see FIG. 7, convex path 90). The law, by which cam profiles 15*a* and 15*b* are realized, coincides with the unmodified law 33. In case of convex path 90 (see FIG. 7), the maximum height is between any neighboring dead centers.

Figure 7:
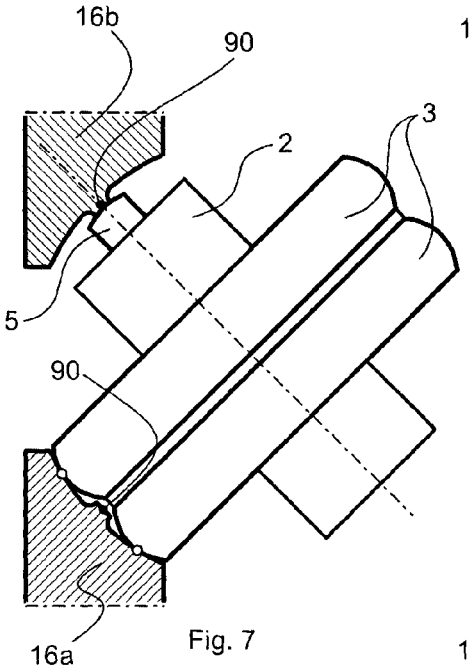
FIG. 7 shows main bearing roller with concave profile and convex path.

FIG. 7 shows one main roller 3 having a concave profile, which is suitable when additional convex paths 90 are made for additional roller 5. These paths 90 are standing out in relation to cam profiles 15*a* and 15*b*.

Figure 8:
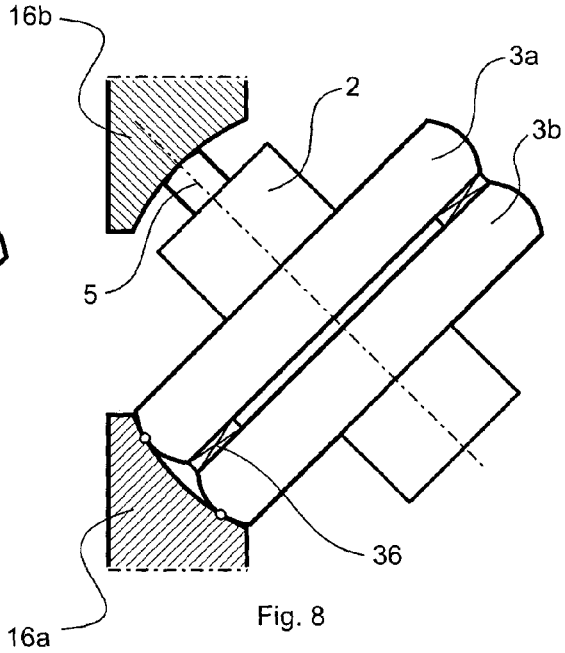
FIG. 8 shows example in which two main rollers are mounted on one main bearing journal.

FIG. 8 shows an example, where each main bearing roller 3 is replaced by two main rollers 3*a* and 3*b* that are mounted on one main bearing journal 2. Between the main bearing rollers 3*a* and 3*b*, mounted on one main bearing journal 2, the axial roller 36 is situated, which prevents the direct contact between rollers 3*a* and 3*b*. The basic intention of this solution is to enable the rollers 3*a* and 3*b*, mounted on one bearing journal, to rotate with different angular rates without friction between them. The advantage is the decreased friction between the main rollers 3*a* and 3*b* and the cam profile that contacts the rollers. When only one main bearing roller 3 is mounted on the bearing journal 2, the friction between the roller 3 and the corresponding cam profile is higher, because the peripheral points of roller 3 do not have the possibility to harmonize their velocities in relation to the different velocities of their adjacent contact points of the corresponding cam profile 15*a* or 15*b*.

| Number, type and range of the section | Law 33 | Modifying law 34 |
|---|---|---|
| 1. Ascending $0 \le \phi \le 45°$ | $S_{33} = \frac{H}{2} - \frac{H}{2} \cdot \sin\left(\frac{\pi}{2} + 2\varphi\right)$ | $S_{34} = \frac{\Delta H}{2} \cdot \left[\frac{\varphi}{\beta} - \frac{1}{2\pi} \cdot \sin\left(2 \cdot \pi \frac{\varphi}{\beta}\right)\right]$ |
| 2. Ascending $45° \le \phi \le 90°$ | | $S_{34} = \frac{\Delta H}{2} - \frac{\Delta H}{2} \cdot \left[\frac{\varphi - \beta}{\beta} - \frac{1}{2\pi} \cdot \sin\left(2 \cdot \pi \frac{\varphi}{\beta}\right)\right]$ |
| 3. Descending $90° \le \phi \le 135°$ | | $S_{34} = \frac{\Delta H}{2} \cdot \left[\frac{\varphi}{\beta} - \frac{1}{2\pi} \cdot \sin\left(2 \cdot \pi \frac{\varphi}{\beta}\right)\right]$ |
| 4. Descending $135° \le \phi \le 180°$ | | $S_{34} = \frac{\Delta H}{2} - \frac{\Delta H}{2} \cdot \left[\frac{\varphi - 3 \cdot \beta}{\beta} - \frac{1}{2\pi} \cdot \sin\left(2 \cdot \pi \frac{\varphi}{\beta}\right)\right]$ |
| 5. Ascending $180° \le \phi \le 225°$ | | $S_{34} = \frac{\Delta H}{2} \cdot \left[\frac{\varphi - 4 \cdot \beta}{\beta} - \frac{1}{2\pi} \cdot \sin\left(2 \cdot \pi \frac{\varphi}{\beta}\right)\right]$ |
| 6. Ascending $225° \le \phi \le 270°$ | | $S_{34} = \frac{\Delta H}{2} - \frac{\Delta H}{2} \cdot \left[\frac{\varphi - 5 \cdot \beta}{\beta} - \frac{1}{2\pi} \cdot \sin\left(2 \cdot \pi \frac{\varphi}{\beta}\right)\right]$ |
| 7. Descending $270° \le \phi \le 315°$ | | $S_{34} = \frac{\Delta H}{2} \cdot \left[\frac{\varphi - 6 \cdot \beta}{\beta} - \frac{1}{2\pi} \cdot \sin\left(2 \cdot \pi \frac{\varphi}{\beta}\right)\right]$ |
| 8. Descending $315° \le \phi \le 360°$ | | $S_{34} = \frac{\Delta H}{2} - \frac{\Delta H}{2} \cdot \left[\frac{\varphi - 7 \cdot \beta}{\beta} - \frac{1}{2\pi} \cdot \sin\left(2 \cdot \pi \frac{\varphi}{\beta}\right)\right]$ |

Figure 9:
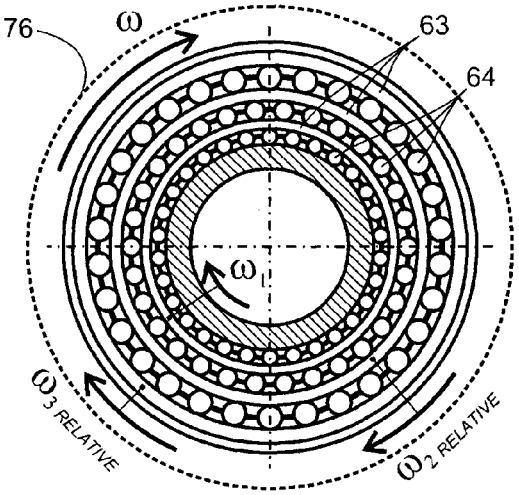
FIG. 9 shows composite bearing.
Figure 12:
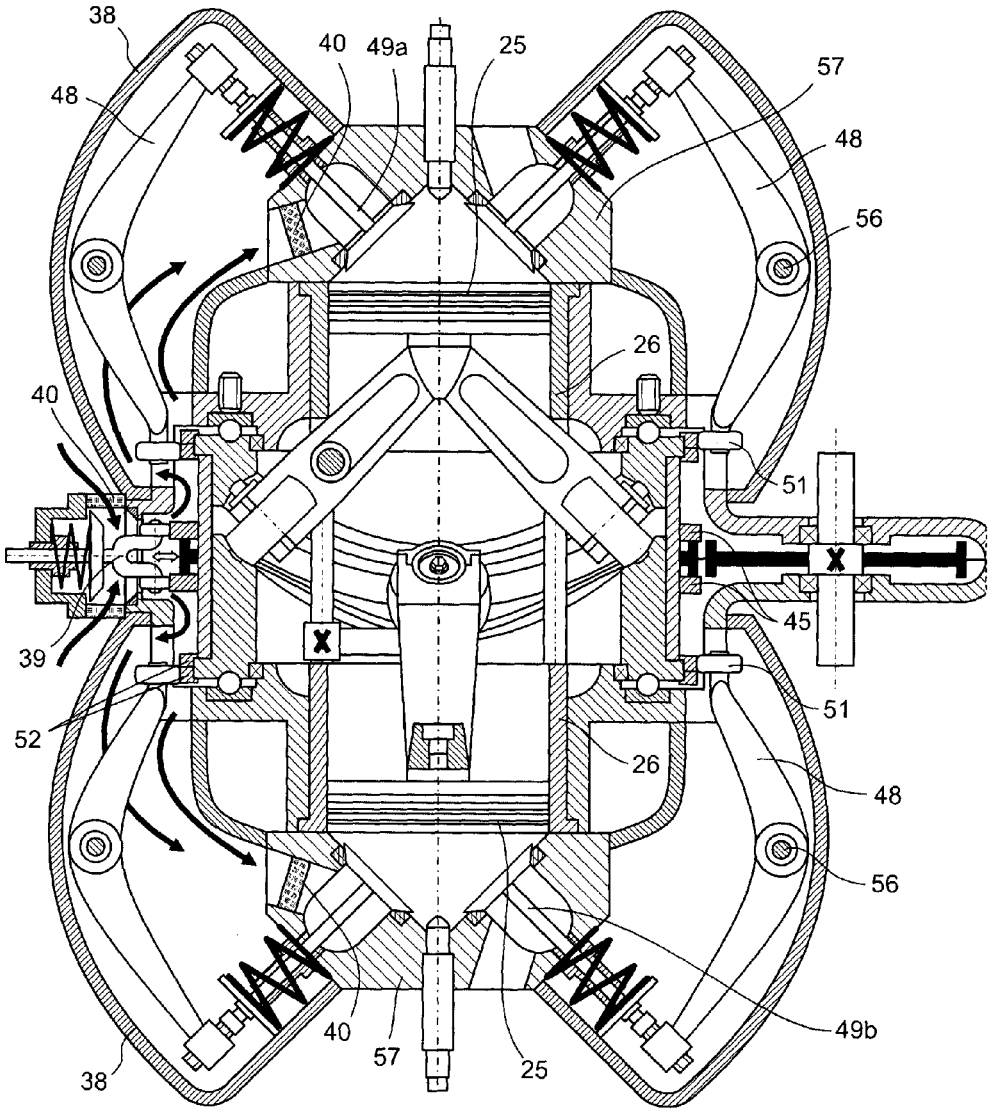
FIG. 12 shows two-piston cam internal combustion engine charged with fresh working substance, passing through its housing.
Figure 13:
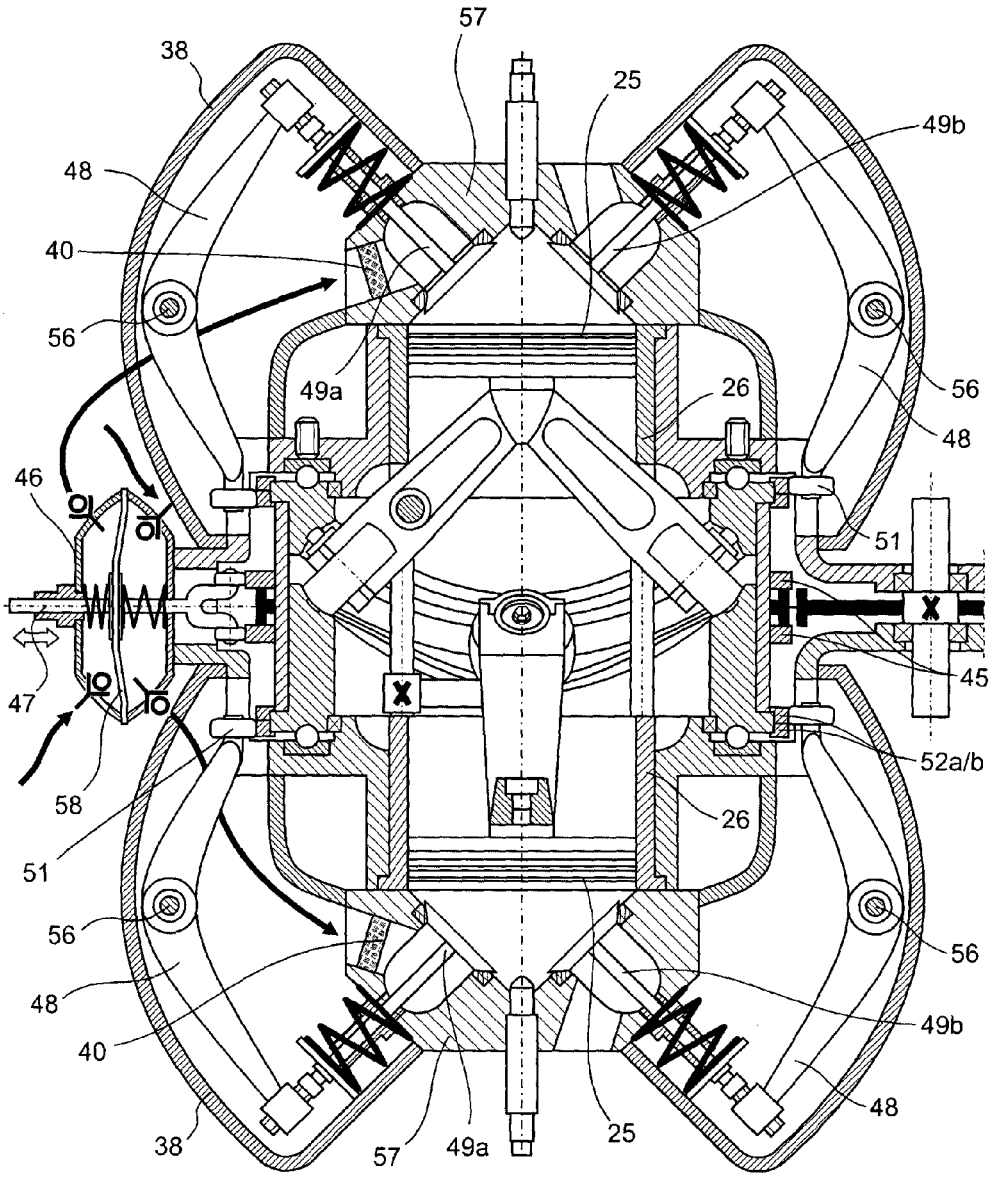
FIG. 13 shows two-piston cam internal combustion engine charged by means of diaphragm pump.

FIG. 9 illustrates the realization of one composite bearing 76, which can be used as means of connecting the main and additional rollers 3 and 5 with the corresponding bearing journals. It will be appropriate also to use composite bearings at the places of contact between rockers 48 and valve-timing cams 52 (FIG. 12 and FIG. 13). It is obvious from the figure that the composite bearing 76 comprises three bearing rings 63 with different diameters, which are concentrically located to each other. Between them rolling bodies 64 are placed, which decrease the forces of friction while the composite bearing is rolling. It is obvious that the net angular velocity of the composite bearing is a sum of the relative angular velocities of each roller level compared to the preceding. Using composite bearings at the places of the piston cam engine mentioned above makes it possible to increase the angular velocity of all its rotational elements without this to cause accelerated wear of the bearings in question.

Figure 10:
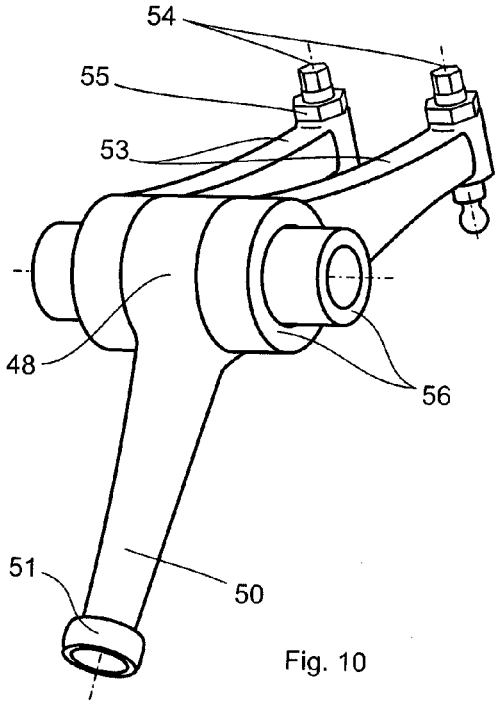
FIG. 10 shows rocker of piston cam engine that can simultaneously set two valves in motion.

FIG. 10 shows one rocker 48 of a piston cam internal combustion engine according to the invention, the purpose of which is to actuate simultaneously two valves 49. It can be seen from the figure that the rocker comprises one arm 50 with roller 51, which contacts one 2D cam 52*a* or 52*b*, shown in FIG. 12, FIG. 13 and FIG. 15; two arms 53 with adjusting screws 54 and counter nuts 55, used to realize the contact between the rocker 48 and the respective valves 49*a* or 49*b*, which can be seen in FIG. 12, FIG. 13 and FIG. 15; and the cylindrical joint 56, by means of which the rocker 48 is connected to a static element of the engine.

Figure 11A:
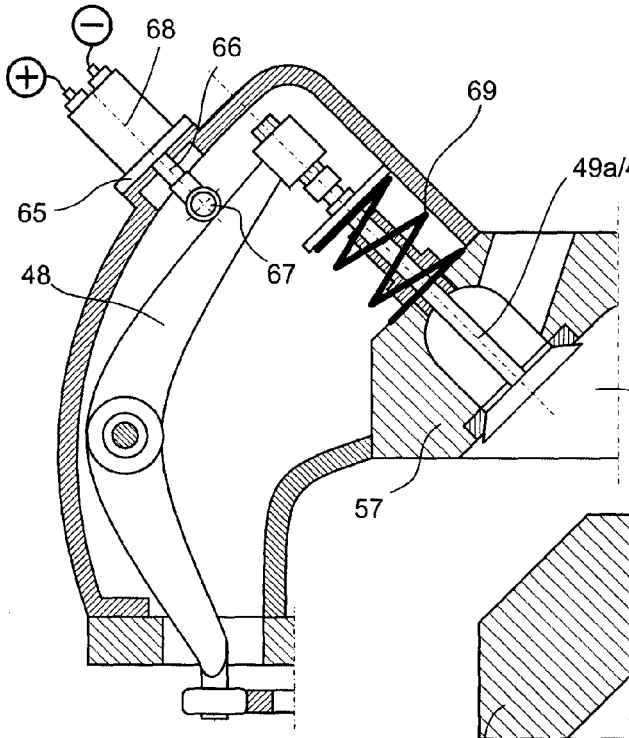
FIG. 11*a*, FIG. 11*b* and FIG. 11*c* show mechanisms for decompression.

FIG. 11*a* shows an example of a decompression mechanism according to the invention. This mechanism includes an electromagnet 65, which armature 66 is profile-wisely connected to rocker 48 of one suction or discharge valve 49*a*/49*b* of the valve-timing mechanism of the engine. In this case, the armature 66 of the electromagnet 65 ends with roller 67 that contacts with the arm 53 of the rocker 48, and a coil 68 of the electromagnet 65 is rigidly connected to the static body element 38. When the piston engine is in a starting mode, the armature 66 of the electromagnet 65 presses the arm 53 that on its turn actuates its adjacent valve 49*a*/49*b*, and compresses its spring 69 as well. In this way no compression is realized in the cylinder by the decompression mechanism. When the number of revolutions (RPM) of the engine becomes high enough to overcome the resistance of compression in its cylinders, the electromagnet 65 is deactivated. This mechanism can be realized by simplified variations of the basic option, described bellow.

Figure 11B:
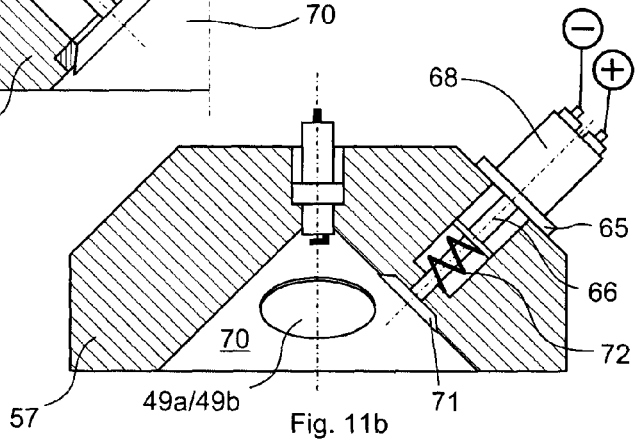

FIG. 11*b* illustrates one of these options. It includes the electromagnet 65, a additional decompression valve 71, different from the valve-timing mechanisms 49*a*/49*b*, and a retracting spring 72. In this case the armature 66 directly affects the decompression valve 71, which opens or closes opening 77 and shrinks and releases its adjacent retracting spring 72. The function of this example of the decompression mechanism is identical to that of the basic variant of the mechanism. This example is applicable when the combustion chamber 70 is large enough to provide enough space for the decompression valve 71.

Figure 11C:
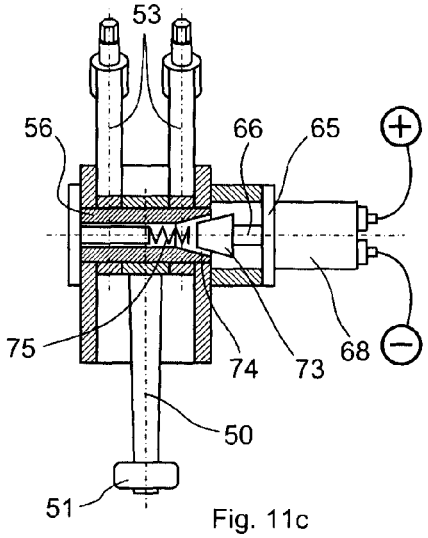

In FIG. 11*c* a subsequent example of the decompression mechanism is presented, which comprises the electromagnet 65, the function of which is to keep the rocker 48 in a position, when the respective suction or discharge valve or valves 49*a*/49*b* are opened and prevent the compression in their adjacent operating cylinder. In this case, the free end of the armature 66 is linked to a conical element 73 that is in contact with the axis 56 of the rocker 48 and the conical element 73 retains the rocker 48 in such a position, that keeps the corresponding valve or valves 49*a* and/or 49*b* opened up to the desirable moment. The axis 56 of rocker 48 has a conical section 74 at its opening, and thus the rocker 48 transfers a moment of rotation from arm 50, contacting its respective valve-timing cam, to arms 53, contacting their adjacent valves.

FIG. 12 illustrates a variant of a piston cam engine, which in this case is realized as two-piston internal combustion engine. In this variant the spaces of the engine housing and the intake manifold 38 are connected. As a result of this connection the charging of cylinders 26 is improved, because the pressure in the engine housing is higher than the atmospheric pressure. The enhanced housing pressure is due to the synchronous bringing near of pistons 25 when valve 39 is closed. In the opposite movement of the pistons 25 a fresh working substance is sucked up from the environment, and enters the engine housing space through the valve 39 and filters 40. Valve 39 is activated by two 2D cams 45, which are rigidly connected to the 3D cam 20.

FIG. 13 shows next example, by which it is improved the fresh working fluid charging of a two-piston internal combustion engine according to the invention. For this purpose, a diaphragm pump 46 is added to the construction of the engine, whose plunger 47 and the diaphragm 58 are put into action by two 2D cams 45, and the flow of fresh working fluid is directed straight from the pump to the intake manifold 38. The flow of fresh working fluid is guided by a system of one-way check valves 59. To prevent the excessive increase in the pressure of the housing space, it is appropriate to add an overflow valve to the system providing the fresh working fluid.

Figure 14:
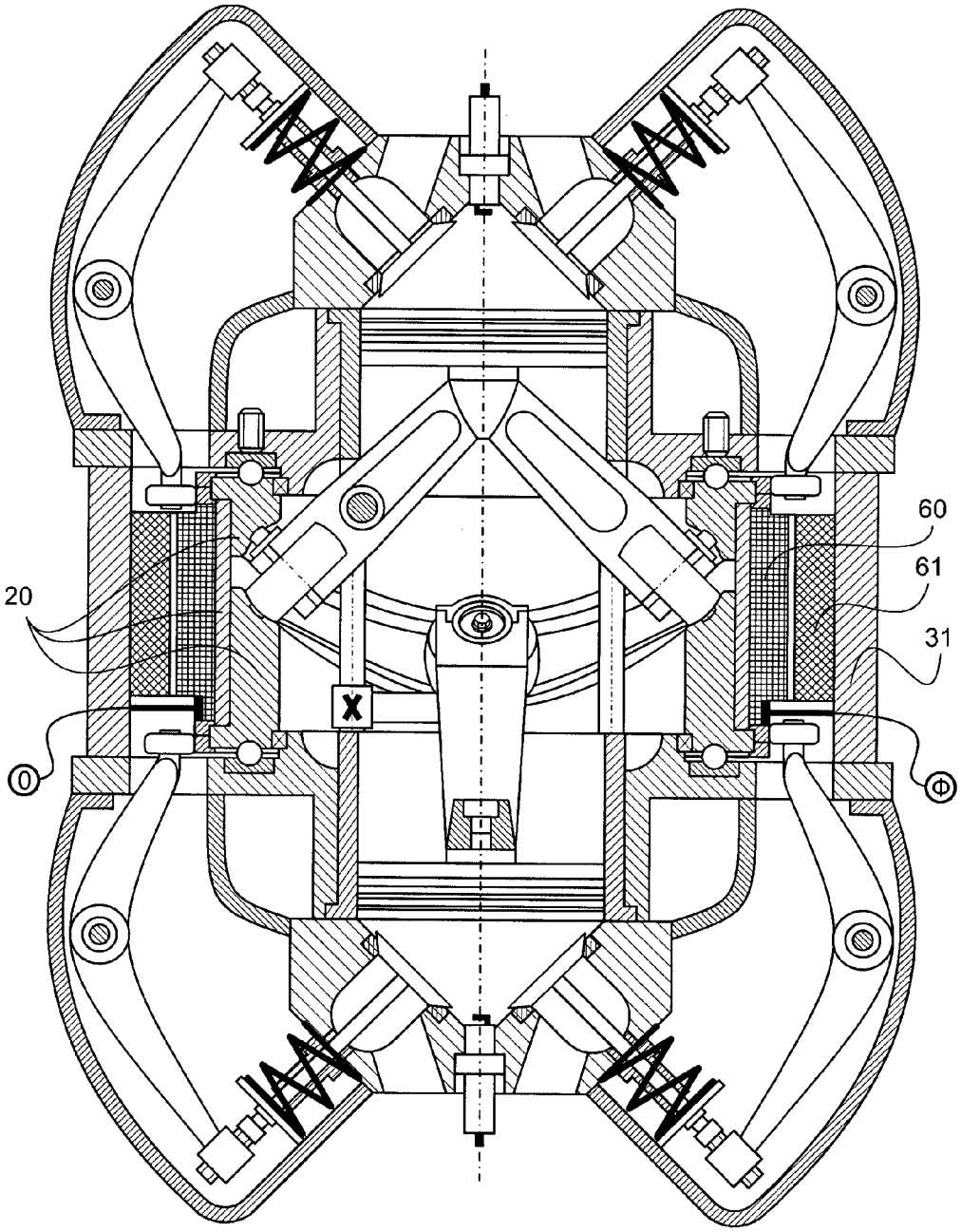
FIG. 14 shows two-piston cam internal combustion engine combined with electric engine.

FIG. 14 illustrates the integration between a two-piston internal combustion engine and an electric engine according to the invention. The integration of the electric engine is realized by a rigid connection of the rotor 60 to the 3D cam 20, so that the 3D cam 20 and the rotor 60 rotate as a single body. A stator 61 of the electric engine is fixed to the housing 31 of the engine. The shown integration decreases the number of parts in comparison to the case, in which the engine and the electric engine are connected as two independent engines. Another advantage of such integration is the increase of efficiency due to the elimination of friction forces between the parts that fall off from the cam engine and electrical generator/motor as a result of their integration. Next advantage of the embedding of the electric engine in the built of the two-piston cam engine is its usage as a start motor, when the engine is working in a starting mode. In this way an additional start motor will not be necessary. The shown integration does not include input/output shaft and the respective gear set that connects it to the 3D cam 20. These components may be assembled in the body of the composite two-piston cam engine, when it is necessary to obtain not only electrical, but mechanical energy as well. The input/output shaft 30 and its gear set 28 and 29 are presented in FIG. 1, FIG. 12 and FIG. 13. A similar alternative of incorporation is when the rotor of the electric engine is directly connected to the input and/or output shaft of the cam engine.

Figure 15:
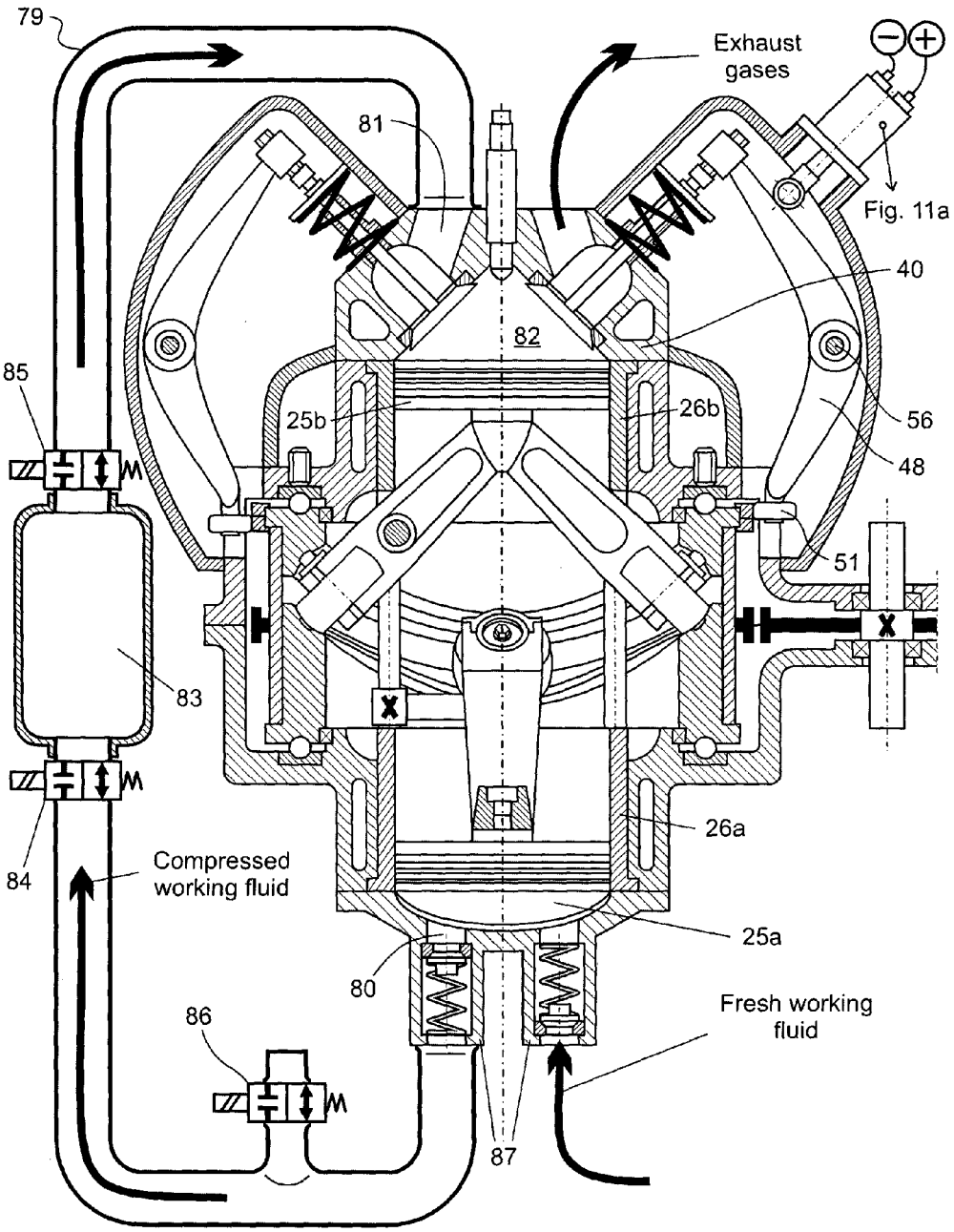
FIG. 15 shows two-piston cam internal combustion engine with split cycle.

FIG. 15 shows a two-piston internal combustion engine according to the invention, whose working cycle of which is split. The suction and compression phases of the engine working cycle are realized in cylinder 26*a*, and the combustion process, expansion and discharge of the exhaust gases are realized in the other cylinder 26*b*. It is obvious from the figure that the two cylinders 26*a* and 26*b* are connected between themselves by means of conduit 79, through which the compressed working fluid is transferred from the compressing cylinder 26*a* to the operating cylinder 26*b*. So the compressed working fluid passes through the exhaust orifice 80 of the compressing cylinder 26*a* and enters the operating cylinder 26*b* through the input orifice 81 of combustion chamber 82 of cylinder 26*b*. FIG. 15 shows variant with a split working cycle of the two-piston engine according to the invention, where the transmission of the compressed working fluid from cylinder 26*a* to cylinder 26*b* is indirectly realized. In this case, the compressed working fluid is initially collected in the intermediate pneumatic accumulator 83 and later used by the operating cylinder 26*b*. The accumulation and the usage of the compressed working fluid are controlled by the two valves 84 and 85, situated respectively at the entrance and the exit of the accumulator 83. FIG. 15 also shows a decompression mechanism, described in FIG. 11*a*, and an electromagnetic valve 86, the function of which is to discharge cylinders 26*a* and/or 26*b* in the cases when they are not used temporarily. In this case, the compressing cylinder 26*b* is serviced by the pair of one-way check valves 87.

Figure 16:
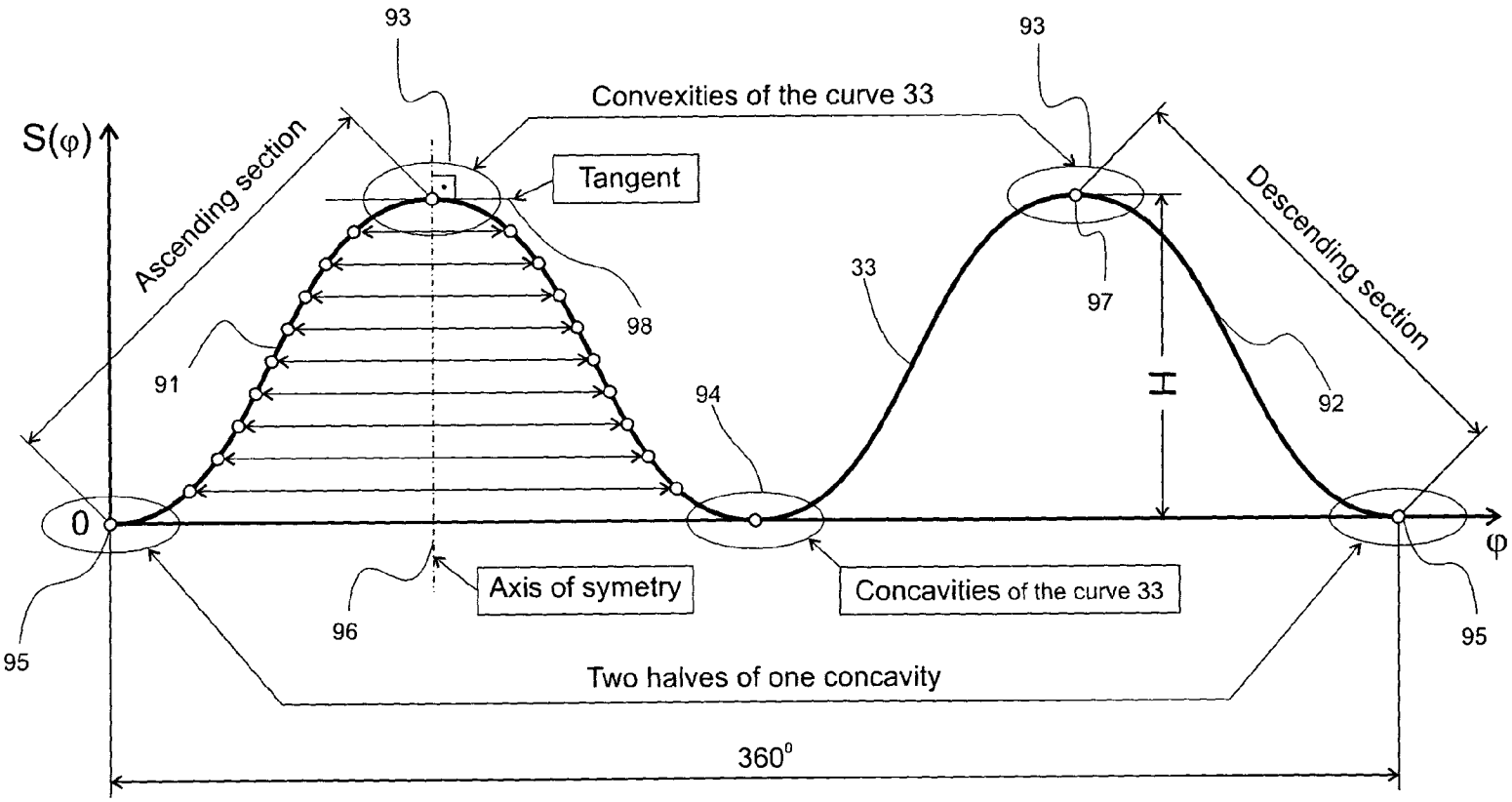
FIG. 16 shows properties of the law of the followers of the cam engine without modification of the law according to FIGS. 3*a* and 3*b;*
Figure 17A:
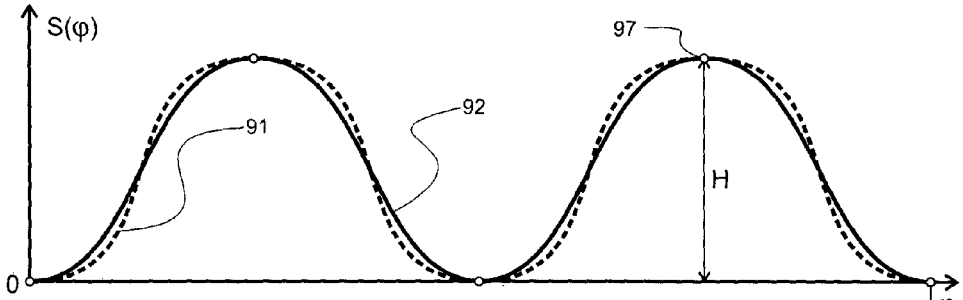
FIGS. 17*a* and 17*b* show laws of the followers and their second derivatives that are not interrupted and whose extreme values are not located with the ends of any ascending are descending section of the law without modification of the law according to FIGS. 3*a* and 3*b;*
Figure 17B:
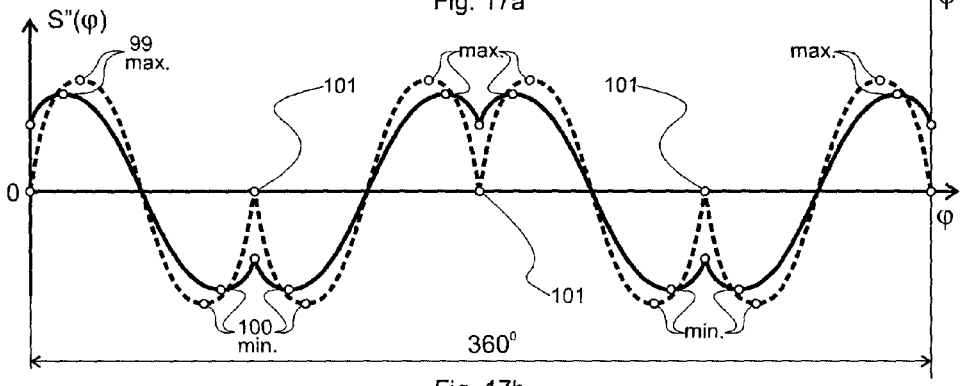
Figure 18A:
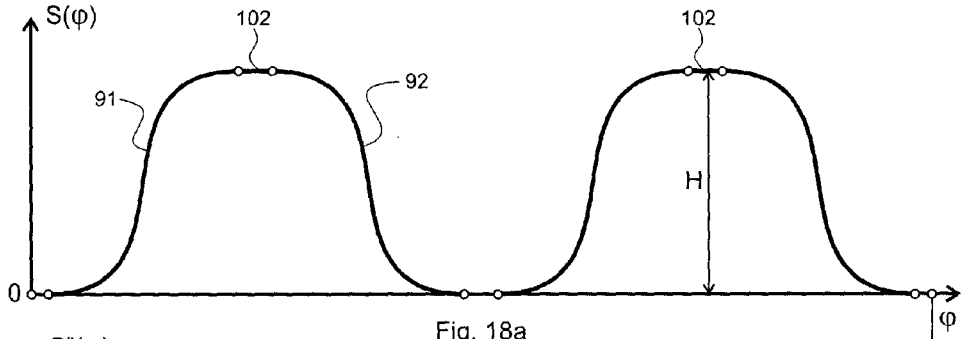
FIGS. 18*a* and 18*b* show a law of the followers and their second derivatives with rectilinear horizontal sections in each location of the curve of the law corresponding to a dead center of the pistons, without modification of the law according to FIGS. 3*a* and 3*b*.
Figure 18B:
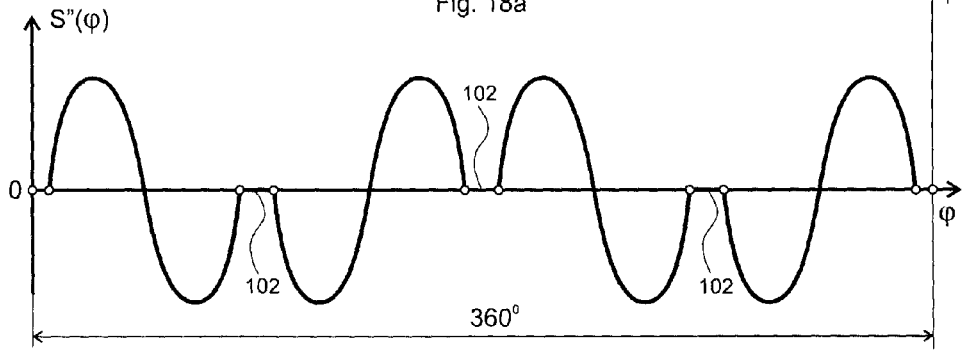

FIG. 16, FIG. 17*a/b* and FIG. 18*a/b* show different law of the followers.

Although the description above contains many specifics, these should not be construed as limiting the scope of the invention but as merely providing illustrations of some of the presently preferred embodiments of this invention. Thus, the scope of this invention should be determined by the appended claims and their legal equivalents.

The invention claimed is:

1. A cam engine, comprising:

(a) a housing (21, 22, and 31);

(b) at least one cylinder (26) carried in said housing;

(c) at least two pistons (25) moving reciprocally within said cylinders (26) or at least one piston (25) moving reciprocally within said cylinder (26) and at least one balancer with mass equal to the piston (25);

(d) a tubular 3D cam (20) having a cam groove formed along the internal surface of said tubular 3D cam, and wherein said cam groove has a periodically-changing concave cross-section so that the width of the cross-section of said cam groove decreases between each neighboring dead center (88, 89) and a bottom end of said cam groove is located distally with respect to a cylindrical axis of said tubular 3D cam (20);

(e) at least two asynchronously moving followers (1*a*, 1*b*), positioned opposite each other, wherein each follower of said at least two followers (1*a*, 1*b*) includes at least two arms (37) and one piston (25) or one balancer is connected to one follower of said at least two followers (1*a*, 1*b*), said at least two arms (37) being positioned at an angle with respect to each other, and wherein each arm of said at least two arms (37) has a free end carrying at least one main roller (3) mounted on a tubular-shaped main journal (2) and wherein said main journal (2) also includes a cylindrical plunger (6) which cylindrical plunger (6) carries an additional bearing journal (4) with an additional roller (5) and the cylindrical plunger (6) together with additional bearing journal (4) and additional roller (5) moves (17) forth and back along an axis of said tubular-shaped main journal (2), so that said at least one main roller (3) and said additional roller (5) remain in contact the cam groove, wherein the cylindrical plunger (6) together with additional bearing journal (4) and additional roller (5) rotates (18) around the axis of the tubular-shaped main journal (2) so that the additional roller (5) self-adjusts in order to achieve rolling without sliding, and wherein said main journal (2) contains positioning nuts (14) for adjusting position of said additional roller (5), and limiting elements (9 or 43) to limit a movement (17) of the additional roller (5) along the axis of the tubular-shaped main journal (2).

2. The cam engine according to claim 1, wherein the cam groove is formed so that along lines of rolling of the additional rollers (5) there are formed narrower grooves (32) having the greatest depth at the top and bottom dead centers (88, 89), and minimum depth between the top and bottom dead centers (88, 89), so that the movement (17) of the additional rollers (5) along axes of the main rollers (3) is reduced the most.

3. Cam engine according to claim 1, wherein the cam groove is made so that along lines of rolling of the additional rollers (5) there are narrower convex paths (90) formed having the greatest height between two neighboring dead centers (88, 89), and their height at top and bottom dead centers (88, 89) is minimum, so that the movement (17) of the additional rollers (5) along axes of the main rollers (3) is reduced the most.

4. Cam engine according to claim 1, wherein the tubular 3D cam (20) comprises two coaxial cam bushings (16*a*, 16*b*), each having a cam profile (15*a*, 15*b*) on one side, and the two coaxial cam bushings (16*a*, 16*b*) are situated at a distance one from another with their ends facing each other so that the profile of one of the two coaxial cam bushings are of opposes the cam profile of the other coaxial cam bushing of the two coaxial cam bushings, wherein said cam engine further comprises at least two guiding columns (27) for the reciprocating linear motion of each piston (25), which two guiding columns (27) are parallel and at an equal distance from the axis of 3D tubular 3D cam (20).

5. Cam engine according to claim 1, wherein said cam groove has cam profiles (15*a*, 15*b*) are formed on the interior of said tubular 3D cam (20) so that a curve (33) of the law of motion of the followers (1*a*, 1*b*), when following said cam profiles (15*a*, 15*b*), is a function of an angle of rotation of the tubular 3D cam (20) and wherein said cam profiles (15*a*, 15*b*) have consecutively alternating ascending and descending sections (91, 92) that define an equal number of convexities and concavities (93, 94), the total number of which convexities and concavities is equal to or a multiple of the sum of the number of arms (37) of the followers (1*a*, 1*b*) and which function is continuous at least up to its second derivative within one complete 360° rotation of the tubular 3D cam (20), for including both end points (95); and which function is symmetrical for each adjacent ascending and descending sections (91, 92) toward a line (96) passing through a point of their junction (97) and the line (96) is perpendicular to a tangent (98) to the curve (33) the junction (97).

6. Cam engine according to claim 1, further comprising an electric rotor (60) rigidly connected to the tubular 3D cam (20) and a stator (61) rigidly connected to the housing (31) of the engine thereby forming, in combination, a piston engine and an electric generator or motor.

7. Cam engine according to claim 1, wherein said cam engine also comprises valves for delivery and discharge of working fluid (49*a*, 49*b*).

8. Cam engine according to claim 1, wherein the main and additional rollers (3, 5) are external bearing rings of composite bearings (76) including multiple bearing rings (63) with different diameters, situated concentrically to each other, and the connection between them is sliding or through rolling bodies (64).

9. Compressor, comprising a cam engine according to claim 1.

10. Pump, comprising a cam engine according to claim 1.

11. Motor, comprising a cam engine according to claim 1 and wherein said motor further comprises at least one kinematic chain having a 2D cam (52) connected to the tubular 3D cam (20); at least one intake or exhaust valve (49*a*, 49*b*) located in a cylinder head (57); a rocker (48) connected by means of cylindrical joint (56) to a static component of the motor, and, adjacent to the rocker (48), one arm (50), through which rocker (48) is in contact with the 2D cam (52), and at least one other arm (53) contacting an intake or exhaust valve (49*a*, 49*b*).

12. Motor according to claim 11, further comprising a supercharging mechanism having at least one valve (39) for opening a housing of the motor to let atmospheric air in when the pistons (25) are moving apart and located on the housing, and at least one 2D cam (45) for managing a movement of the valve (39), which 2D cam (45) is mounted to the 3D cam (20).

13. Motor according to claim 11, further comprising a supercharging mechanism, having at least one diaphragm pump (46) located on the housing of the motor for supercharging atmospheric air in an intake manifold (38) of the motor, and at least one 2D cam (45) for actuating a motion of a diaphragm pump (46), which 2D cam (45) is mounted to the 3D cam (20).

14. Motor according to claim 11, further comprising an operating cylinder (26*b*) functioning as a heat engine, and one opposed cylinder (26*a*) functioning as a compressor or a pump.

15. Motor according to claim 14, wherein that the opposed cylinder (26*a*) is a cylinder of a compressor having a pneumatic accumulator (83) for feeding the operating cylinder (26*b*) with at least a part of compressed air from the opposed cylinder (26*a*).

16. A cam engine, comprising:

(a) a housing (21, 22, and 31);

(b) at least one cylinder (26) carried in said housing;

(c) at least one piston (25) moving reciprocally within said cylinder (26);

(d) a tubular 3D cam (20) having a cam groove formed along an internal surface of said tubular 3D cam, and wherein said cam groove has a periodically-changing concave cross-section so that the width of the cross-section of said cam groove decreases between each neighboring dead center (88, 89) and a bottom end of said cam groove is located distally with respect to the cylindrical axis of said tubular 3D cam (20); and (e) at least two asynchronously moving followers (1*a*, 1*b*), positioned opposite each other, wherein each follower of said at least two followers (1*a*, 1*b*) includes at least two arms (37) and one piston of said at least one piston (25) is connected to one follower of said at least two followers (1*a*, 1*b*), said at least two arms (37) being positioned at an angle with respect to each other, and wherein each arm of said at least two arms (37) has a free end carrying at least one main roller (3) mounted on a tubular-shaped main journal (2) and wherein said main journal (2) also includes a cylindrical plunger (6) which cylindrical plunger (6) carries an additional bearing journal (4) with an additional roller (5) and the cylindrical plunger (6) together with additional bearing journal (4) and additional roller (5) performs back and forth movement (17) along the axis of said tubular-shaped main journal (2), so that said at least one main roller (3) and said additional roller (5) remain in contact the cam groove, wherein the cylindrical plunger (6) together with additional bearing journal (4) and additional roller (5) performs rotation (18) around the axis of the tubular-shaped main journal (2) so that the additional roller (5) self-adjusts in order to achieve rolling without sliding, and wherein said main journal (2) contains positioning nuts (14) for adjusting position of said additional roller (5), and limiting elements (9 or 43) to limit movement (17) of the additional roller (5) along the axis of the tubular-shaped main journal (2).

17. A cam engine, comprising:

(a) a housing (21, 22, and 31);

(b) at least one cylinder (26) carried in said housing;

(c) at least one piston (25) moving reciprocally within said cylinder (26);

(d) at least one balancer with mass equal to the piston (25);

(e) a tubular 3D cam (20) having a cam groove formed along an internal surface of said tubular 3D cam, and wherein said cam groove has a periodically-changing concave cross-section so that the width of the cross-section of said cam groove decreases between each neighboring dead center (88, 89) and a bottom end of said cam groove is located distally with respect to the cylindrical axis of said tubular 3D cam (20);

(f) at least two asynchronously moving followers (1*a*, 1*b*), positioned opposite each other, wherein each follower of said at least two followers (1*a*, 1*b*) includes at least two arms (37) and one piston of said at least one piston (25) or one balancer is connected to one follower of said at least two followers (1*a*, 1*b*), said at least two arms (37) being positioned at an angle with respect to each other, and wherein each arm of said at least two arms (37) has a free end carrying at least one main roller (3) mounted on a tubular-shaped main journal (2) and wherein said main journal (2) also includes a cylindrical plunger (6) which cylindrical plunger (6) carries an additional bearing journal (4) with an additional roller (5) and the cylindrical plunger (6) together with additional bearing journal (4) and additional roller (5) performs back and forth movement (17) along the axis of said tubular-shaped main journal (2), so that said at least one main roller (3) and said additional roller (5) remain in contact with the cam groove, wherein the cylindrical plunger (6) together with additional bearing journal (4) and additional roller (5) performs rotation (18) around the axis of the tubular-shaped main journal (2) so that the additional roller (5) self-adjusts in order to achieve rolling without sliding, and wherein said main journal (2) contains positioning nuts (14) for adjusting position of said additional roller (5), and limiting elements (9 or 43) to limit movement (17) of the additional roller (5) along the axis of the tubular-shaped main journal (2).

18. A cam engine according to claim 1, wherein the cam groove has cam profiles (15*a*, 15*b*) with top and bottom dead centers (88, 89) formed on the interior of tubular 3D cam (20) and wherein the cam groove is made so that, at the top and bottom dead centers (88, 89), a distance between the cam profiles (15*a*, 15*b*) of the cam groove of the tubular 3D cam (20) in the cross-section is the greatest, and a distance in the cross-section between the cam profiles (15*a*, 15*b*) of the cam groove of the tubular 3D cam (20) between the each two neighboring dead centers (88, 89) is the smallest, so that movement (17) of additional rollers (5) along axes of the main rollers (3) is reduced the most.

19. Cam engine according to claim 6 that comprises additionally an input or output shaft.

* * * * *